United States Patent [19]

Zare et al.

[11] Patent Number: 4,988,879

[45] Date of Patent: Jan. 29, 1991

[54] APPARATUS AND METHOD FOR LASER DESORPTION OF MOLECULES FOR QUANTITATION

[75] Inventors: Richard N. Zare, Stanford, Calif.; Friedrich Engelke, Bielefeld, Fed. Rep. of Germany; Jong H. Hahn, Stanford, Calif.

[73] Assignee: The Board of Trustees of the Leland Stanford Junior College, Stanford, Calif.

[21] Appl. No.: 18,875

[22] Filed: Feb. 24, 1987

[51] Int. Cl.[5] ..... H01J 27/24; H01J 46/26

[52] U.S. Cl. ..... 250/423 P; 250/288; 250/282

[58] Field of Search ..... 250/281, 282, 288, 423 P

[56] References Cited

U.S. PATENT DOCUMENTS

| | | | |
|---|---|---|---|
| 4,468,468 | 8/1984 | Benninghoven et al. | 250/288 |
| 4,658,135 | 4/1987 | Alleman et al. | 250/288 |
| 4,745,277 | 5/1988 | Banar et al. | 250/288 |
| 4,920,264 | 4/1990 | Becker | 250/288 |

FOREIGN PATENT DOCUMENTS 0222730 5/1985 Fed. Rep. of Germany .

OTHER PUBLICATIONS

Hieftje, G. M., Travis, J. C., Lytle, F. E., eds. "Lasers in Chemical Analysis," The Humana Press: Clifton, N.J. 1981.

Kliger, D. S. ed., "Ultrasensitive Laser Spectroscopy", Academic Press, New York, 1983.

Keller, R. A., ed. "Laser-Based Ultrasensitive Spectroscopy and Detection V".

Zare, R. N., *Science*, 1984, 226 298.

Delgass, W. N., Cooks, R. G., *Science* 1987, 235 54–5.

Conzemius, R. J., Capellen, J. M., *Int. J. Mass Spec. Ion Phys.*, 1980 34 197.

Burlingame, A. L., Baillie, T. A., Derrick, P. J., *Anal. Chem.* 1986, 58(5) 165R.

Benninghoven, A. Sichtermann, W. K., *Anal. Chem.* 1978, 50, 1180.

*Anal. Chem.*, 1978, 50, 985.

Stoll R., Rollgen, F. W., *Org. Mass Spec.* 1979, 14, 642.

Antonov, V. S., Letokhov, V. S., Shibanov, A. N., *Appl. Phys.* 1981, 25, 71.

Tabet, J. C., Cotter, R. J., *Anal. Chem.* 1984, 56, 1662.

Egorov, S. E., Letokhov, V. S. Shibanov, A. N., *Chem. Phys.* 1984, 85, 349.

Deviney, M. L., Gland, J. L. eds. "Catalyst Characterization Science", American Chemical Society, Washington, D.C., 1985, pp. 238–251.

Karas, M., Bahr, U., *Trends in Anal. Chem.* 1986, 5, 90.

Wilkins, C. L., Weil, D. A., Yang, C. L. C., Ijames, C. F., *Anal. Chem.* 1985, 57, 520.

(List continued on next page.)

OTHER PUBLICATIONS

Brown, R. S., Wilkins, C. L., *Anal. Chem.* 1986, 58, 3196.

Brown, R. S., Wilkins, C. L., *J. Am. Chem. Soc.* 1986, 108, 2447.

Coates, M. L., Wilkins, C. L., *Anal. Chem.* 1987, 59 197.

Holm, R., Karas, M., Vogt, H. *Anal. Chem.* 1987, 59, 373.

Hercules, D. M., Day, R. J., Balasanmugam, K. Dant, T. A. Li, C. P., *Anal. Chem.* 1982, 54, 280A.

Hercules, D. M., *Pure & Appl. Chem.* 1983, 55, 1869.

Antonov, V. S., Egorov, S. E., Letokhov, V. S., Shibanov, A. N., *JETP LETTER* 1983, 38, 217.

Becker, C. H., Gillen, K. T., *Anal. Chem.* 1984, 56, 1671.

Becker, C. H., Gillen, K. T., *J. Opt. Soc. Am. B.* 1985, 2, 1438.

Nogar, N. S., Estler, R. C., Miller, C. M., *Anal. Chem.* 1985, 57, 2441.

Tembreull, R., Lubman, D. M., *Anal. Chem.* 1986, 58, 1299.

Frey, R., Weiss, G., Kaminski, H., Schlag, E. W., *Z. Naturforsch. Teil A* 1985, 40 1349.

Walter K., Bosel, U., Schlag, E. W., *Int. J. Mass Spectrom. Ion Pro.* 1986, 71, 309.

*Primary Examiner*—Bruce CX. Anderson

*Attorney, Agent, or Firm*—Majestic, Parsons, Siebert & Hsue

[57] ABSTRACT

A method and device for volatilizing and thereafter ionizing quantitatable femtomole and smaller amounts of molecules of nonvolatile solid oranic materials is disclosed. The method and device employ a laser pulse to desorb the organic material from a support upon which it is physisorbed. The support and the laser are related to provide a rate of heating of the support surface of at least $10^{6°}$ K./sec with the support withstanding this heating rate without volatilization. Glass and similar inorganic oxidic substrates are preferred. The molecules so generated can be ionized, preferably with the use of resonance-enhanced muiltiphoton ionization. The ions so formed are characterized by a heavy predominance of ions corresponding to the molecules so as to permit their sensitive and unambiguous resolution by mass spectrometry.

48 Claims, 9 Drawing Sheets

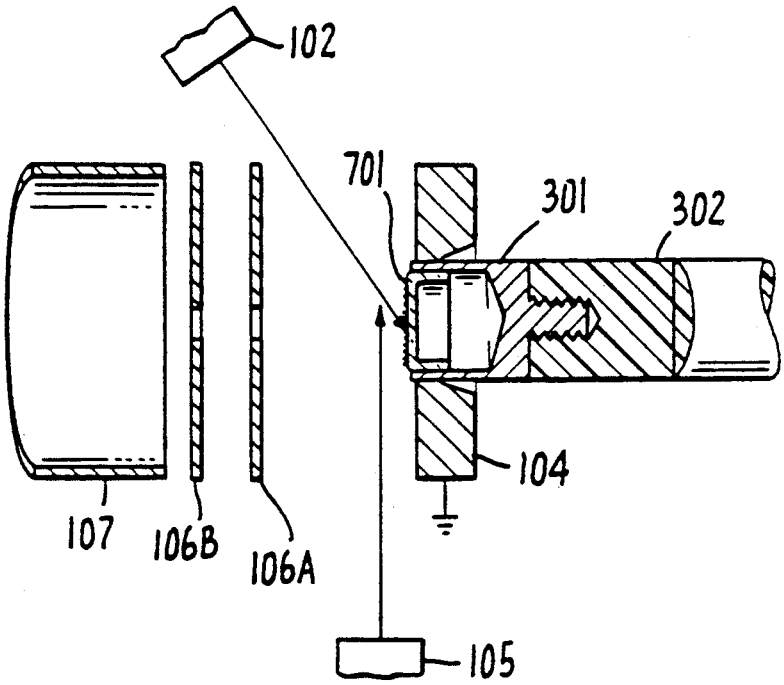
FIG. 7
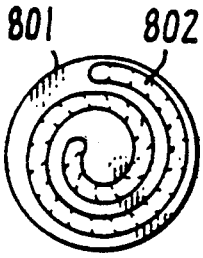
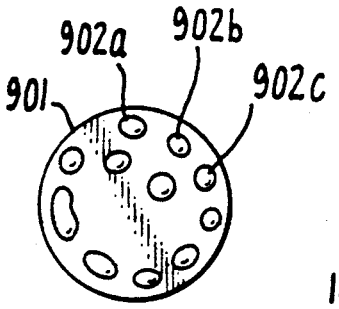
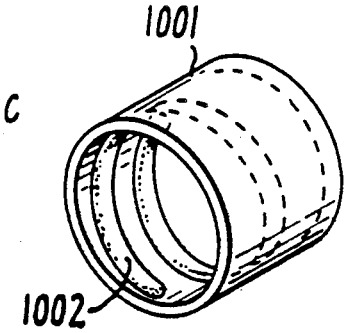
FIG. 8 FIG. 9 FIG. 10

APPARATUS AND METHOD FOR LASER DESORPTION OF MOLECULES FOR QUANTITATION

BACKGROUND OF THE INVENTION

1. Field of the Invention

This invention concerns a laser-based device for volatilizing quantitatable amounts of nonvolatile solid organic compounds. In a preferred embodiment, this laser volatilizing device is coupled to a second laser capable of ionizing the volatilized molecules to provide a laser-based ion source which generates reproducible bursts of ions from nonvolatile solid organic compounds with negligible fragmentation. The ions so generated can be used to accurately quantitate the organic compounds. In the present device, a pulse of energy from a first laser generates a cloud of volatilized molecules of the solid analyte off of a support selected to permit and facilitate rapid, localized heating. In the ion source a pulse of energy from a second laser reproducibly ionizes a portion of the molecules in the cloud. In preferred embodiments this ion source is used to generate ions which are resolved in a mass spectrometer apparatus. The use of this ion source permits femtomoles or less of nonvolatile molecules to be quantitated in mass spectrometers.

2. Background Information

Chemical analyses can be carried out to identify or "qualitate" materials in a sample. Analyses can also be carried out to not only identify materials in a sample but also measure the amounts of these materials. This latter type of analysis is referred to as a "quantitative" analysis or as "quantitation". To permit quantitation, an analytical technique must generate a result or signal which is reproducible in magnitude as well as in identity and which is related to the amount of analyte. The present invention provides a laser-based volatilizer and ion source which generates volatilized molecules and ions of nonvolatile solid organic compounds with such a level of precision and reproducibility that, for the first time, it is possible to base quantitative analytical methods upon the ions so generated. Because this invention involves both the field of lasers and the field of ion-based analytical methods such as mass spectrometry, in this Background section art related to laser-based analytical techniques will be presented first, followed by art related to ion-based analytical methods.

The development of laser-based analytical methods in recent years has been rapid. Recent general reviews of these advances include Hieftje, G.M., Travis, J.C., Lytle, F.E., eds., "Lasers in Chemical Analysis," The Humana Press: Clifton, NJ, 1981; Kliger, D.S., ed., "Ultrasensitive Laser Spectroscopy"; Academic Press: New York, 1983; Keller, R.A., ed., "Laser-Based Ultrasensitive Spectroscopy and Detection V," *Proc. Soc. Phot-Opt. Instrum. Eng.* 1983, 426; and Zare. R.N., *Science* 1984, 226, 298; Delgass, W.N., Cooks, R.G., *Science* 1987, 235, 54–5.

particularly dramatic has been the explosive growth in laser-assisted mass spectrometry. A very complete review of this area entitled "A Review of the Application to Solids of the Laser Ion Source in Mass Spectrometry" was published by Conzemius. R.J., and Capellen, J.M., in *Int. J. Mass Spec. Ion Phys.*, 1980, 34, 197, while an equally thorough review of recent work may be found at Burlingame. A.L., Baillie, T.A., Derrick. P.J., *Anal. Chem.* 1986, 58(5), 165R.

Mass spectral analysis has become increasingly important as a method of identification of materials. A most severe limitation in the mass spectral analysis of thermally labile or highly polar compounds is that thermal evaporation of the sample is required. In most cases the energy needed for the evaporation step exceeds that for thermal degradation. Primarily for this reason, many biologically important substances have proven intractable in analysis by classical mass spectrometric methods. To address this problem, a number of less destructive techniques have been proposed to facilitate the introduction of these materials into mass spectrometry. These include condensed-phase ejection-ionization methods like the improved thermal desorption method (Rizzo. T.R., Park. Y.D., Peteanu. L.A., Levy, D.U., *J. Chem. Phys.* 1986, 84, 2534); field desorption (Beckey. H.D., "Principles of Field Ionization and Field Desorption Mass Spectrometry," Pergamon Press: New York, 1977); Plasma desorption (Benninghoven. A., ed., "Ion Formation from Organic Solids," Springer-Verlag: Berlin. 1983, part 2); sputtering of substances as secondary ions by bombardment with energetic primary ions (SIMS) (Benninghoven, A., Sichtermann, W.K., Anal. Chem. 1978, 50, 1180; Benninghoven, A., Colton, R.J., Simons, D.S., & Werner, H.W., eds., "Secondary Ion Mass Spectrometry SIMS V," Springer Series in Chemical Physics 44, Springer-Verlag: Berlin, 1986); sputtering of substances as secondary ions by bombardment with atoms (FAB) (Benninghoven. A., ed., "Ion Formation from Organic Solids," Springer-Verlag: Berlin, 1983, part 3); thermospray (Blakley, C.R., Vestal, M.L., *Anal. Chem.* 1983. 55, 750; Vestal, M.L., Fergusson. G.J., *Anal. Chem.* 1985, 57, 2373); and electrospray (Whitehouse, C.M., Dreyer, R.N., Yamashita, M., Fenn, J.B., *Anal. Chem.* 1985, 57, 675). The general concept of using a laser to directly generate ionic species from solids also has been suggested by a number of laboratories (see, for example, Posthumus. M.A., Kistemaker, P.G., Meuzelaar, H.L.C., *Anal. Chem.* 1978, 50, 985; Stoll, R., Rollgen, F.W., *Org. Mass Spec.* 1979, 14, 642; Antonov, V.S., Letokhov. V.S., Shibanov, A.N., *Appl. Phys.* 1981, 25, 71; Antonov. V.S., Letokhov, V.S., Matveyets. YU.A., Shibanov, A.N., *Laser Chem.* 1982, 1, 37; Tabet, J.-C., Cotter, R.J., *Anal. Chem.* 1984, 56. 1662; Egorov, S.E., Letokhov. V.S., Shibanov. A.N., *Chem. Phys.* 1984, 85, 349; Deviney, M.L., Gland, J.L., eds., "Catalyst Characterization Science." American Chemical Society: Washington. D.C., 1985, pp. 238–251; Karas. M., Bahr, U., *Trends in Anal. Chem.* 1986, 5, 90: Sherman M.G., Kingsley, J.R., Hemminger, J.C., McIver, R.T., Jr., *Anal. Chim. Acta* 1985, 178, 79; Wilkins. C.L., Weil, D.A., Yang, C.L.C., Ijames, C.F., *Anal. Chem.* 1985. 57. 520; Brown, R.S., Wilkins, C.L., *Anal. Chem.* 1986, 58. 3196; Brown, R.S., Wilkins, C.L., *J. Am. Chem. Soc.* 1986. 108. 2447; Coates, M.L., Wilkins, C.L., *Anal. Chem.* 1987, 59, 197: Holm, R., Karas, M., Vogt, H., *Anal. Chem.* 1987, 59, 373).

All these techniques have in common that ions are created directly out of the condensed phase by the impact of the bombarding particle, i.e., the fast atoms (Benninghoven, ed., part 3), the ions (Benninghoven, Sichtermann; Benninghoven. Colton et al., eds.), or the laser light photons (Conzemius. R.J., Capellen. J.M., *Int. J. Mass Spec. Ion Phys.* 1980, 34, 197; Hercules. D.M., Day. R.J., Balasanmugam, K., Dant, T.A., Li, C.P., *Anal. Chem.* 1982, 54, 280A; Hercules, D.M., *Pure & Appl. Chem.* 1983, 55, 1869: as well as posthumus et al.; Stoll el al.; Anronov et al., *Appl. Phys.;* Antonov et al., *Laser Chem.;* Egorov et al.; Deviney et al., eds; Karas et al.; Sherman et al.; Wilkins et al.; Brown et al., *Anal. Chem.;* Brown et al., J. *Am. Chem. Soc.;* Coates et al.; Holm et al.). Since single-step processes all rely on a single impact to bring about desorption and ionization, there has been no ability to independently vary desorption or ionization conditions. This has led to problems with reproducibility from analysis to analysis on a given sample as well as with variation in efficiency from sample to sample. These problems interfere with the ability to carry out a quantitative analysis with this method.

One improvement in laser ion generation techniques has been to divide the process into two separate steps—a desorption step to generate gaseous particles (molecules or atoms) from the solid, followed by ionization of the gaseous particles in a second step with a separate second laser pulse. This is possible because most of the desorbed material is in the neutral rather than in the ionic state, often with an ion-to-neutral ratio in the range of $10^{-3}$ to $10^{-5}$. Descriptions of prior multistep systems can be found in Antonov, V.S., Letokhov, V.S., Matveyets, YU. A., Shibanov, A.N., *Laser Chem.* 1982, 1, 37; Antonov, V.S., Egorov, S.E., Letokhov, V.S., Shibanov, A.N., *JETP Lett.* 1983, 38, 217; Becker, C.H., Gillen, K.T., *Anal. Chem.* 1984, 56. 1671; Becker, C.H., Gillen, K.T., *J. Opt. Soc. Am. B* 1985, 2, 1438: Nogar, N.S., Estler, R.C., Miller, C.M., *Anal. Chem.* 1985, 57, 2441; and Tembreull, R., Lubman. D.M., *Anal. Chem.* 1986, 58, 1299; Frey, R., Weiss, G., Kaminski. H., Schlag, E.W., *Z. Naturforsch. Teil A* 1985, 40, 1349; Walter, K., Bosel, U., Schlag, E.W., *Int. J. Mass Spectrom. Ion Pro.* 1986, 71, 309; Grotemeyer, I., Bosel, U., Walter, K., Schlag, E.W., *J. Am. Chem. Soc.* 1986, 108. 4233.

The Antonov et al. system employs a high power $CO_2$ laser to desorb submolecular films of anthracene and naphthalene from a graphite surface. The desorbed aromatics are then irradiated with a pulse of light from a KrF excimer laser to give rise to a large population of ions. A problem with this system is that the fluence of the $CO_2$ laser is very high, and contact of the laser beam with the graphite substrate gives rise to generation of $C^+$ and $C_2^+$ ions directly from the graphite surface, even though the surface is cooled to −73° C. ostensibly to prevent this.

The Becker et al. work is directed to a process referred to as surface analysis by laser ionization or "SALI". In the process an ion or laser beam sputters or desorbs material such as elemental metals or metal hydride from a surface (generally a metal surface). Next the neutral material released from the surface is irradiated with a focused high intensity burst of nonresonant multiphoton ionization energy. Then in a third step these ions are accelerated forward, focused, and allowed to drift in a field-free region for the time-of-flight detection. Again, this process has the failing that the desorption conditions are so harsh that they give rise to a background of secondary ions sputtered from the surface. In the second Becker et al. paper, resonant multiphoton ionization is compared with the nonresonant ionization which was shown in the first paper, with the results suggesting that nonresonant ionization is equal or superior to resonant multiphoton ionization. Becker et al. addresses elemental analyses and fails to demonstrate quantitation. The Nogar et al. system is also designed to address elemental detection. Tembreull et al. and Schlag and coworkers have developed methods which use laser desorption from a solid sample into a supersonic jet of a carrier gas for transport to a separate ionization zone. However, due to the increase of complexity in the passage of molecules from desorption region to ionization region, transmission efficiency of desorbed molecules significantly decreases and is not constant at a fixed experimental condition. Because of these problems, these systems do not permit quantitation.

Tembreull et al. describes an additional ion generation system which does not involve gas jet transport of desorbed molecules to the ionization zone. This system was only briefly reported. apparently being less preferred than the gas jet system. The system as described is similar to the present system in some respects but has the failing of employing a long period (200 μsec) between desorption and ionization. Over this period, the cloud of desorbed molecules can disperse and cut down the number of ions generated. This system has other failings, as well. It uses a metal rod as its surface for presenting the test material. The beams of its desorption laser and ionizing laser are coaxial in the sample area. This geometry permits the ionizing laser beam to contact the solid surface carrying the sample and thus to generate additional particles which interfere with accuracy. In addition, this system uses desorption laser power levels which can fragment the molecules being examined and give rise to interferring ionic species.

While these background references represent a substantial body of progress in the field, they also reflect a need for further development. Thus further development is needed to provide a laser-based device which would generate volatilized molecules of nonvolatile materials and ionize the volatilized molecules with such reproducibility that quantitative analyses based on the ions so produced would be possible, especially at the femtomole level or lower. This represents much improved sensitivities. (For example, the SIMS method works at the 100 picomole level). It would further be desirable to have a method and apparatus which would generate quantitative amounts of ions over a substantial range and preferably with linearity over the substantial range. It would also be desirable to have a method and apparatus which would interface well with other analytical methodologies, e.g., liquid chromatography (LC) and would permit samples to be easily introduced into a laser-based ion generator so as allow analyses of the ions so formed to be carried out quickly and easily.

The present invention answers these needs by providing quantitation With high sensitivities, reproducibility and ease of sample handling in the laser-based ion generator.

STATEMENT OF THE INVENTION

It has now been found that nonvolatile organic solids can be volatilized as a quantitatible burst of molecules by a laser desorption technique when the organic material is provided as a physisorbed deposit upon a nonporous solid support surface and when the laser is a pulsed laser having a pulse adequate to essentially completely desorb that portion of the deposit which it strikes with the laser pulse and the support being selected and related to provide a rate of heating of the support surface of at least $10^{6°}$ K/sec without volatilization of the support.

This mode of volatilization is characterized by essentially complete desorption of the organic material off the support and by the generation of the molecules of this organic material without ionization of the organic material.

Representative suitable support surfaces are selected from inorganic oxidic substrate materials.

The invention can be embodied as a process of quantitatible volatilization and as an apparatus for carrying out such volatilizations. This aspect of the invention permits quantitative volatilization of amounts of heat-labile organic materials smaller than a femtomole with the promise of quantitation in the attomole ($10^{-18}$ mole) region.

The laser desorption and volatilization as embodied in this invention is characterized by its ability to generate a reproducible pattern of desorbed species upon which quantitation can be based. In one common and attractive result, these desorbed species are predominantly the intact neutral molecules of the nonvolative organic sample. The desorbed species can also predominantly be fragments of the intact neutral molecules or they can be a mixture of intact and fragments. In these latter two cases, the fragments bear a reproducible relationship to the intact parent, and this relationship is constant over the range of quantitation. The fragments can supply a unique signature carrying additional information. For example, it can permit the unambiguous identification of isomeric material and the like. In any of these three cases, the quantity of desorbed species volatilized (intact molecules or fragments alike) bears a linear relationship to the quantity of the intact parent originally on the surface and thus permits its direct quantitation.

The quantitatible burst of volatilized molecules generated in this manner can be ionized for identification and quantitative resolution in mass spectrometers or the like. This ionization can be carried out using a second laser beam or pulse.

The present invention thus also can be embodied as a device and process for generating a quantitatable burst of gaseous ions from a solid organic material. This process includes the following steps.

a. Providing the solid organic material as a physisorbed deposit upon a nonporous solid support surface.

b. Striking a controlled portion of the deposit with a first laser pulse. This laser pulse is of a wavelength, intensity and duration adequate to essentially completely desorb that portion of the deposit struck by the laser off of the inorganic oxidic substrate surface and give rise to a burst of gaseous molecules of the deposited material. This pulse is also such as not to bring about ionization of the particles but also to relate to the surface to give a heating rate on the surface greater than $10^{6}$° K/sec.

c. Passing a second laser pulse through the burst of gaseous molecules at the completion of a controlled time interval. This pulse is noncoaxial with the first pulse and adjacent to the surface of the solid material but does not impact this surface. The second pulse is of a wavelength, intensity and duration adequate to effect resonance enhanced multiphoton ionization of a controlled portion of those gaseous particles which it strikes, thereby producing the quantitatable burst of gaseous ions.

In another aspect, this invention provides a method of mass spectral analysis in which the ions generated as just described are passed through a mass spectrometer so as to determine their masses. In a preferred embodiment of this aspect, the inorganic oxide substrate or other suitable support surface from which the molecules of the sample are desorbed is surrounded by or immediately adjacent to one pole of the acceleration zone of the mass spectrometer so that the ions are generated directly in the ion acceleration zone.

In an additional aspect, this mass spectrometric method is used to quantitate amounts of heat-labile materials over a range of at least five orders of magnitude—from nanomoles to femtomoles and below.

In a particular and preferred aspect and application of this invention, this mass spectral analysis is used to quantitate derivatized amino acids so as to function as a detector for peptides sequencers. In another embodiment it is used to quantitate nucleotides so as to function as a detector for oligonucleotide sequencers.

In additional aspects, this invention provides the volatilizer and the ion generation apparatus, as well as this ion generation apparatus in combination with a mass spectrometer. It also provides the methods for preparing samples on the support surface and for insertion into the ion source as well as the sample carriers and the insertion apparatus used in these processes.

DETAILED DESCRIPTION OF THE INVENTION

Brief Description of the Drawings

In this specification, reference will be made to the accompanying drawings in which:

FIG. 7 is an enlargement of an ionization zone of an ion source of this invention which is similar to the ionization zone shown in FIG. 3 but illustrating an alternative embodiment of the sample holder.

FIG. 8. 9 and 10 illustrate several alternative sample presentation configurations for use in this invention.

a. protoporphyrin IX dimethyl ester.

b. β-estradiol, and c. adenine.

Figure 15:
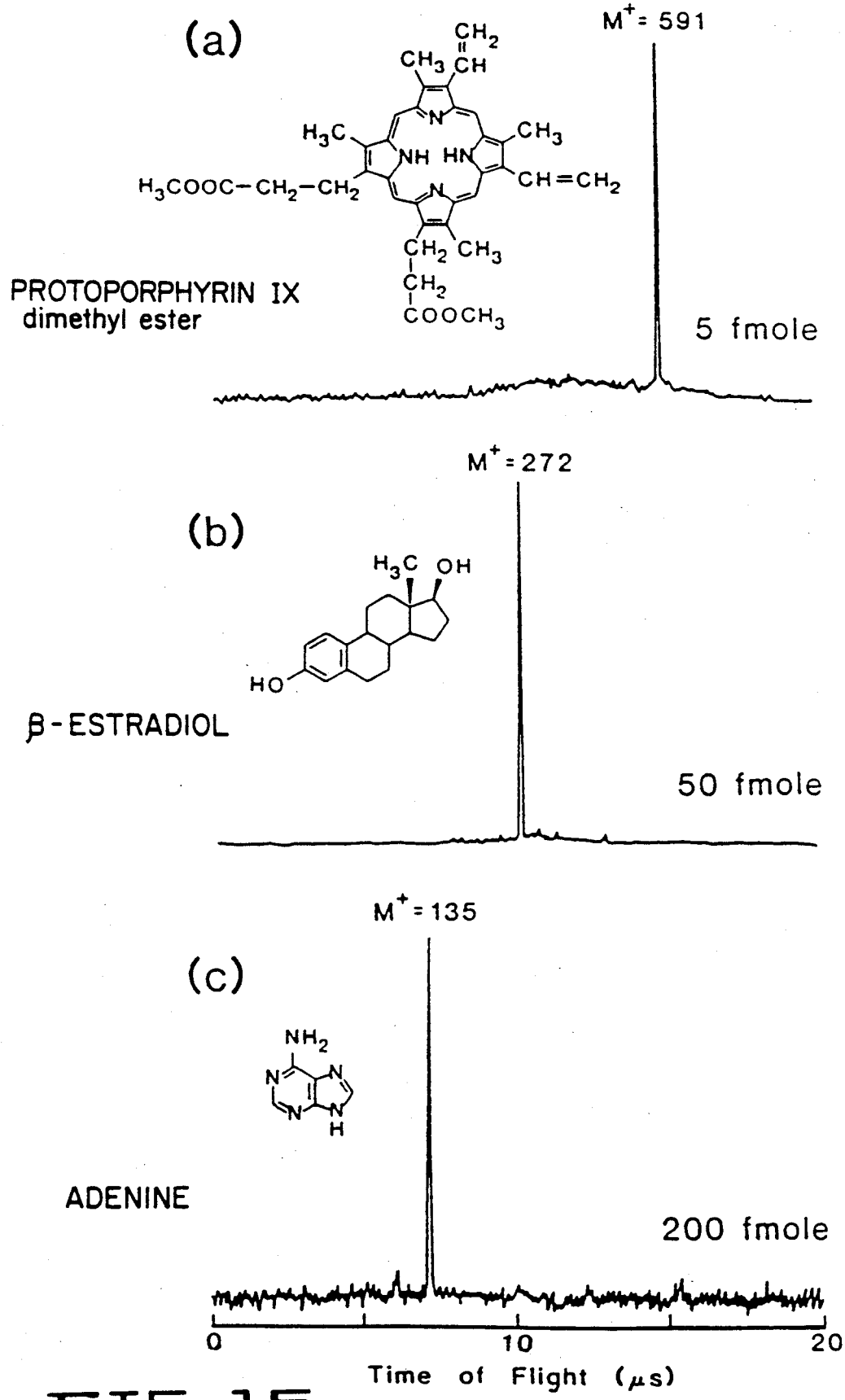
FIG. 15 shows three mass spectrographs obtained using the present volatilizer and ion source illustrating the clear molecule ion signals obtained with a range of samples including.
Figure 16:
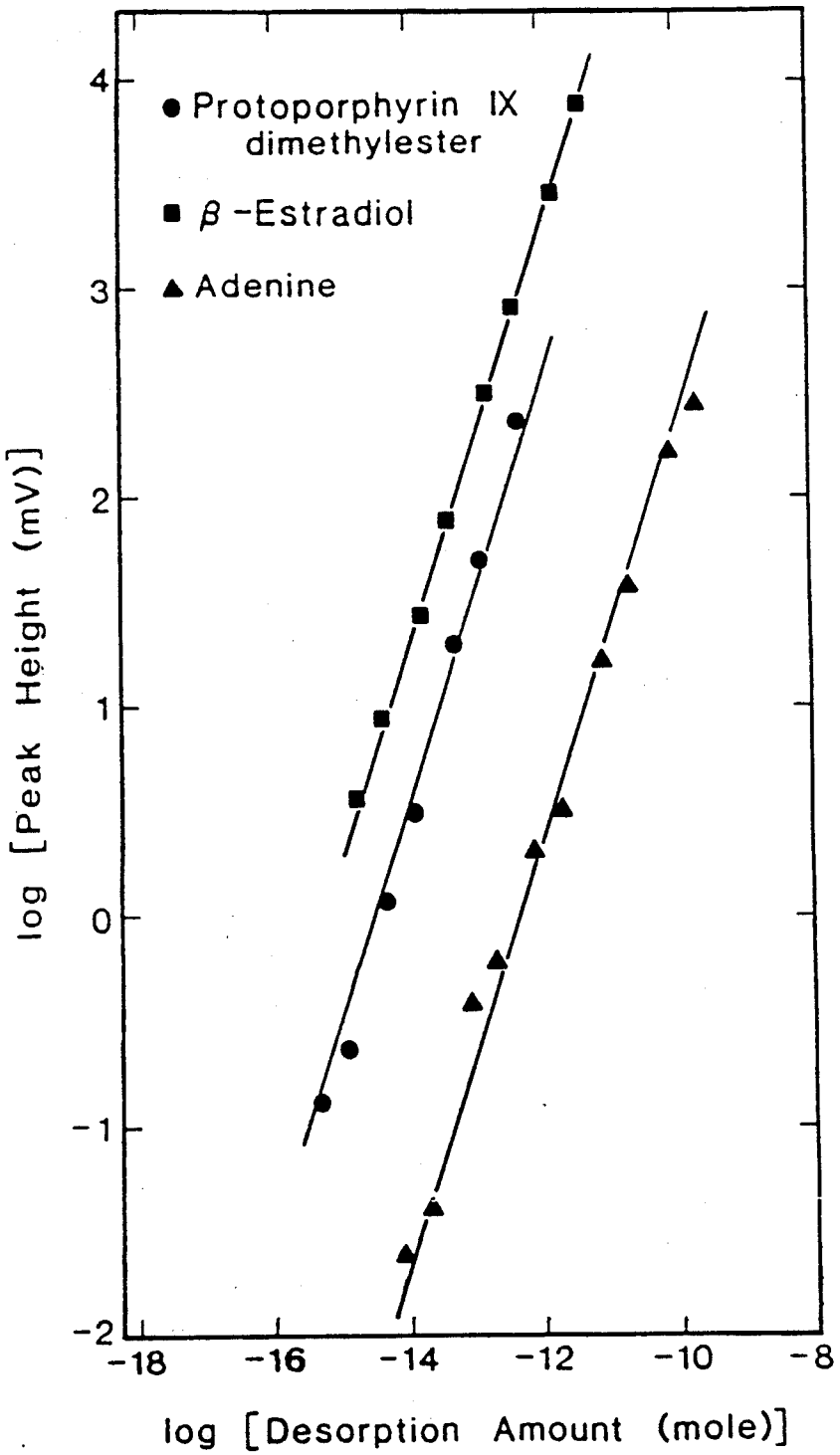

FIG. 16 is a graph illustrating the linearity of mass spectrometer response with each of the materials shown in FIG. 15.

DESCRIPTION OF PREFERRED EMBODIMENTS

The Volatilization Process

In this aspect of the invention. a sample of heat-labile organic material is quantitatively desorbed off of a support surface by application of a laser pulse to the support surface.

By "nonvolatile organic compound" or "nonvolative solid organic compound" or the like is meant a solid molecular organic material without an appreciable vapor pressure at room temperature. More specifically, a solid organic compound is "nonvolatile" within the meaning of this definition if it is a molecular material which has a vapor pressure of less than about $10^{-1}$ Torr at 25° C. preferred "nonvolatile organic compounds" have vapor pressures of less than $10^{-3}$ Torr at 25° C. Sample materials can be chosen without limitation from organic compounds which exist at a molecular level and which meet this definition. Polymer materials and the like which exist as a matrix of coupled and cross-linked molecules are not considered to be molecular compounds and are outside of this definition.

One characteristic of this volatilization is its ability to generate a cloud of volatilized molecules with modest impact on the nonvolatile organic compound molecules themselves. In many cases this can permit the volatilization of thermally labile nonvolatile organic materials as substantially intact molecules. Thus. thermally labile materials constitute one preferred group of materials for volatilization in the present process and apparatus. As used herein, a "thermally labile organic material" or the like is meant to include a solid organic compound which undergoes thermal decomposition in air or vacuum at a temperature of 500° C. or less, preferably at a temperature of 450° C. or less.

Thus, the nonvolatile organic solids which are volatilized can be selected without limitation from solid organic compounds such as pharmaceutical agents and biologically significant materials such as natural products and their derivatives and decomposition products and the like. Typical representative materials include amino acids, polypeptides, peptide fragments. amino acid derivatives. Proteins including immunological proteins and the like, nucleic acids, nucleotides, gene fragments, oligonucleotide sequences, hormones such as cortisone and estradiol and progesterone, and agents such as thyronine, thyroxin, growth factors, pesticides. herbicides, pollutants, residues and the like. This list is absolutely nonlimiting. The invention has been found to work with all sizes and chemical configurations of nonvolatile organic solid materials tested so that, in practice, virtually any other nonvolatile organic solid material can be employed, as well.

Although not to be construed as a limitation on the volatilizer of this invention, the use to which the volatilized molecules is to be put should be kept in mind when selecting the nonvolatile organic material. Most commonly, the volatilized molecules are subjected to ionization, as will be set forth, and the ions so formed are resolved (and preferably quantitated) in one form or another of mass spectrometer.

One can use any of the known types of mass spectrometers, taking into account the differences in their effective ranges of operation. For example, time-of-flight spectrometers tend to work best with particles of molecular weight not substantially exceeding 5000 daltons; reflectrons work up to the 20,000 dalton region; quadrapole units have a similar range; while magnetic sector mass spectrometers and fourier-transform ion cyclotron resonance mass spectrometers can operate with much larger molecules—for example, with weights substantially exceeding 100,000 daltons. Obviously, the type of molecule being quantitated should be related to the capabilities of the mass spectrometer.

A key to this desorption process is the use of a solid support surface upon which the nonvolatile organic compounds are physisorbed. "physisorbed" or "physisorption" refers to a relatively weak bonding process between the surface and the organic compounds. It is to be contrasted with "chemisorption", which denotes a chemical adsorption process. Physisorption is characterized by a bond strength between the compound of less than 20 Kcal/mole and preferably less than about 10 Kcal/mole. The support is nonporous.

The support is further characterized by it ability to withstand heating rates of $10^{6}$° K/sec or higher without undergoing volatilization, ionization or decomposition, preferably the support will withstand heating rates of $5\times10^{6}$° K/sec or higher with more preferred supports withstanding heating rates of $1\times10^{7}$° K/sec or higher.

A further characteristic of the support is its relationship with the characteristics of the desorbing laser. The support should absorb significant amounts of energy at the wavelength of the desorbing laser. Suitably the support should absorb at least ⅔ of the laser energy (i.e., reflect ⅓ or less) and preferably absorbs 70% or more (i.e., a reflectivity of 0.3 or less) and more preferably absorbs 75% or more (i.e., a reflectivity of 0.25 or less).

An additional characteristic of preferred supports is their low thermal conductivity and low thermal diffusivity. Typically, thermal conductivity is 0.5 J/cm·sec·°K or less, preferably 0.25 J/cm·sec·°K, with values of 0.05 J/cm·sec·°K being more preferred. Thermal diffusivity values are 0.1 $cm^2$/sec with 0.05 $cm^2$/sec being preferred and 0.025 $cm^2$/sec being more preferred.

Any materials meeting these limitations can be used. One skilled in the art can determine the values for these parameters for various materials by art-known tests. Metals such as steel, copper and the like do not work; neither do graphite and similar materials.

It has been found generally that inorganic oxidic materials satisfy these requirements. On this basis, they are preferred.

The term "inorganic oxidic substrate" or "inorganic oxidic material" includes vitreous materials such as glass, fused silica, fused quartz, and the like, as well as oxidic refractory materials including ceramics such as alumina, fired clays, silica-alumina, boria, titania, magnesia, mixtures thereof, and the like, with or without glazes or other surface treatments such as silylation or the like.

This substrate can be uniform in cross-section or it can be nonuniform (anisotropic) in cross-section, as desired. Typical anisotropic supports can be generally porous with a continuous "skin" or top layer upon which the sample is carried. The inorganic oxidic substrate can be a composite material containing two or more layers, at least the top one of which is the desired inorganic oxidic material. Of the inorganic materials, vitreous materials are preferred.

Glass has proven to be an excellent substrate for use with $CO_2$ desorption lasers Based on its ready availability and the ease with which it can be shaped and fashioned into desired configurations, glass is preferred. Glass has a reflectivity of 0.15 at the 10.6 μm wavelength of the $CO_2$ laser, a thermal conductivity of 0.010–0.015 J/cm·sec·°K and a thermal diffusivity of 0.01 $cm^2$/sec or less. It has been found to permit heating rates of up to $10^8$°K/sec without any decomposition or ionization.

The thickness of the support is not considered critical, and any thickness up to as much as a centimeter or more which provides adequate physical strength for handling can be used.

An advantage of the present support is its ability to carry a wide range of sample thicknesses and still give linear response over a range of orders of magnitude of sample size of at least five. This linearity can be found over a far wider range with sample thicknesses ranging from as little as $10^{-6}$ monolayers or smaller to as much as $10^2$ monolayers or more. More commonly, sample thicknesses in the range of from about $10^{-5}$ monolayers to about $10^2$ monolayers are employed.

Figure 1:
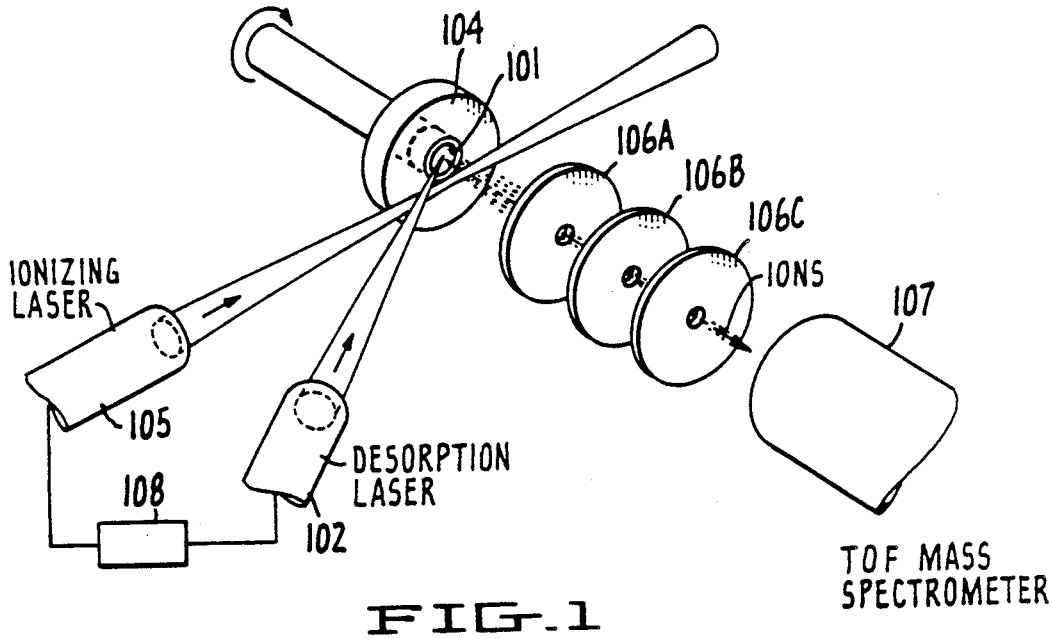
FIG. 1 is a stylized schematic perspective view of a sample volatilizer and ion source of this invention illustrating their modes of operation.

The desorption laser 102 is trained on the layer of sample on the support surface 101 as shown in FIG. 1. The desorption laser provides the desired desorption when it has a wavelength related to the support as noted above. With the inorganic supports, wavelengths can be in the infrared or visible range, especially in the 11 to 0.4 μm wavelength range, and preferably in the 11 to 1 μm range. Typical fluences give the desired rapid heating of from about 50 to about 1000 mJ/$cm^2$, and especially from about 75 to about 600 mJ/$cm^2$. pulse length used for desorption will be chosen to give the desired heating rate. (Generally times from about 1 nsec to about 100 μsec. and especially from about 10 nsec to about 10 μsec are employed. Other times which give the desired heating rates can be used.)

Examples of suitable desorbing lasers include any pulsed laser with these properties, such as pulsed dye lasers, the $CO_2$ laser, the 1.06 micrometer fundamental wavelength Nd:YAG laser and the like.

The desorbed cloud of molecules preferably is employed in a mass spectrometer. In this application, the molecules (or more commonly a reproducible fraction of them) are first ionized. This can be advantageously carried out using the laser ionization process described below. Other ionization processes could be used as well, if desired. Typical processes include fast atom bombardment, ion bombardment or the like.

The Overall Ionization Process

In a preferred embodiment of the overall ionization process of this invention, the sample (the nonvolatile organic compound or mixture including such organic compounds) is deposited as a solid film (i.e., a layer) on an inorganic oxide surface. The inorganic oxide surface with the film of sample is placed in a high vacuum (such as $10^{-5}$ Torr or less and preferably $10^{-6}$ Torr or less absolute pressure). A laser beam having the properties of wavelength and fluence suitable for desorbing and vaporizing but not ionizing the solid sample is directed upon the film for a controlled time period adequate to effect desorption and vaporization. Neutral molecules are generated in a fast desorption process. Because of the inorganic oxide support, this desorption is virtually complete for the area directly contacted by the beam while other regions adjacent to the contacted area are virtually unaffected. The cloud of desorbed molecules then expands into the high vacuum chamber between two electrodes which form the acceleration region of a linear time of flight ("TOF") mass spectrometer. In a second step these molecules are ionized by a beam (preferably a pulse) of an ultraviolet laser having the properties of wavelength, fluence and pulse duration to bring about resonance-enhanced multiphoton ionization ("REMPI") of the vaporized molecules. An appropriate delay between the desorbing laser pulse and the ionizing laser pulse is chosen so that the ionizing laser pulse intercepts as many molecules as possible.

An element of the present methodology is the spatial and temporal separation of desorption and ionization. This allows one to select the energies and pulse durations for each of these two steps independently. By choosing suitable parameters for both lasers, one can make the detection of organic molecules, such as derivatives of the amino acids or the like, quantitative with a linear response over many orders of magnitude in concentration. Moreover, the use of 1+1 REMPI in which one photon causes electronic excitation of the organic molecule and a second photon causes ionization of the excited state is both highly selective and efficient. The high sensitivity of REMPI combined with the small amount of sample needed in the desorption step allows the use of this method to analyze samples of biologically important molecules with a detection limit in the femtomole range or less.

Turning to the drawings. FIG. 1 is a stylized schematic illustrating the relationship of elements in a device of this invention. The device includes a time-of-flight ("TOF") mass spectrometer made up of ground electrode 104, charged electrodes 106A, 106B and 106C. which provide an ion-accelerating potential relative to electrode 104, and drift tube 107. At the other end of drift tube 107 is a detector (which is not shown in FIG. 1) which detects the flight time of ions through the drift tube. Electrode 104 is "doughnut" shaped and a sample carrier 101 having the desired inorganic oxidic substrate with a layer of sample thereupon is positioned within the center hole in electrode 104. Laser 102 is the desorption laser. Laser 105 is the ionizing laser. Controller 108 relates and controls the delivery of the pulses of the two lasers.

When the beam of desorption laser 102 strikes the layer of sample, it desorbs the sample and gives rise to a cloud of neutral molecules of the sample. Neutral molecules are generated in a fast desorption process. Because of the inorganic oxide support, this desorption is virtually complete for the area directly contacted while other regions adjacent to the contacted area are virtually unaffected. In view of the placement of the sample carrier 101 within electrode 104, the cloud of desorbed molecules then expands into the high vacuum chamber between electrodes 104 and 106A which form the acceleration region of a linear time-of-flight ("TOF") mass spectrometer. In a second step these molecules are ionized by a pulse from a laser capable of achieving resonance-enhanced multiphoton ionization ("REMPI") of the desorbed species. Characteristics of the ionization laser are a wavelength generally in the ultraviolet range, for example, in the range of from about 400 nm to about 190 nm, and especially 300 nm to about 240 nm, and a fluence of from about 0.1 to about 10 mJ/cm$^2$, and especially from about 0.2 to about 5 mJ/cm$^2$. The laser pulse length used for the ionization step can be selected in the range of from about 1 nsec to about 100 nsec. In general, the longer the pulse width, the greater the proportion of particles ionized, preferred pulse widths range from about 2 nsec to about 75 nsec.

Examples of suitable ionizing lasers include the ultra-Violet (frequency-quadrupled) Nd:YAG laser, the frequency-doubled dye laser, the KrF laser, the ArF laser, and the like.

The two laser beams are not coaxial. The desorbing laser 102 is directed upon the surface of inorganic oxidic sample carrier 101 while the ionizing laser 105 passes through the ion acceleration zone adjacent to but without touching the solid inorganic oxidic sample carrier or the sample on its surface.

The time delay between the two laser pulses should be such as to permit the ionizing laser beam to contact as many particles as possible. Generally, this is achieved when the period from the beginning of desorption to the beginning of ionization is adjusted on the order of from about 20 to about 180 μsec and preferably from about 30 to about 150 μsec.

The ions so generated are accelerated by electrodes 106A, B, and C and pass down the drift tube 107 to the detector. This detector and the methods of handling the data it generates are conventional. Details of one arrangement for analyzing the results from the detector are provided in the Examples.

Figure 2:
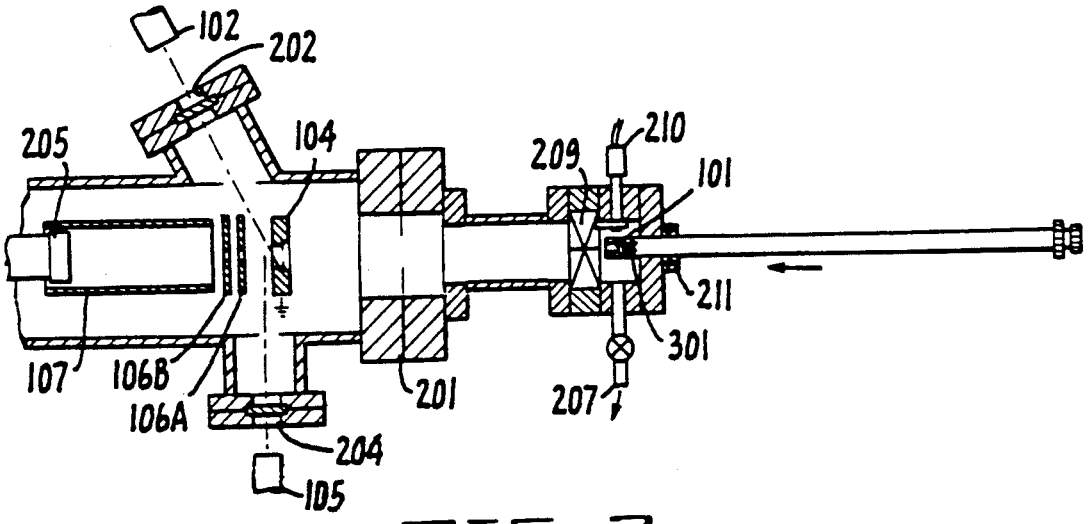
FIG. 2 is a horizontal cross-section of a volatilizer and ion source of this invention with a sample being inserted into it.
Figure 3:
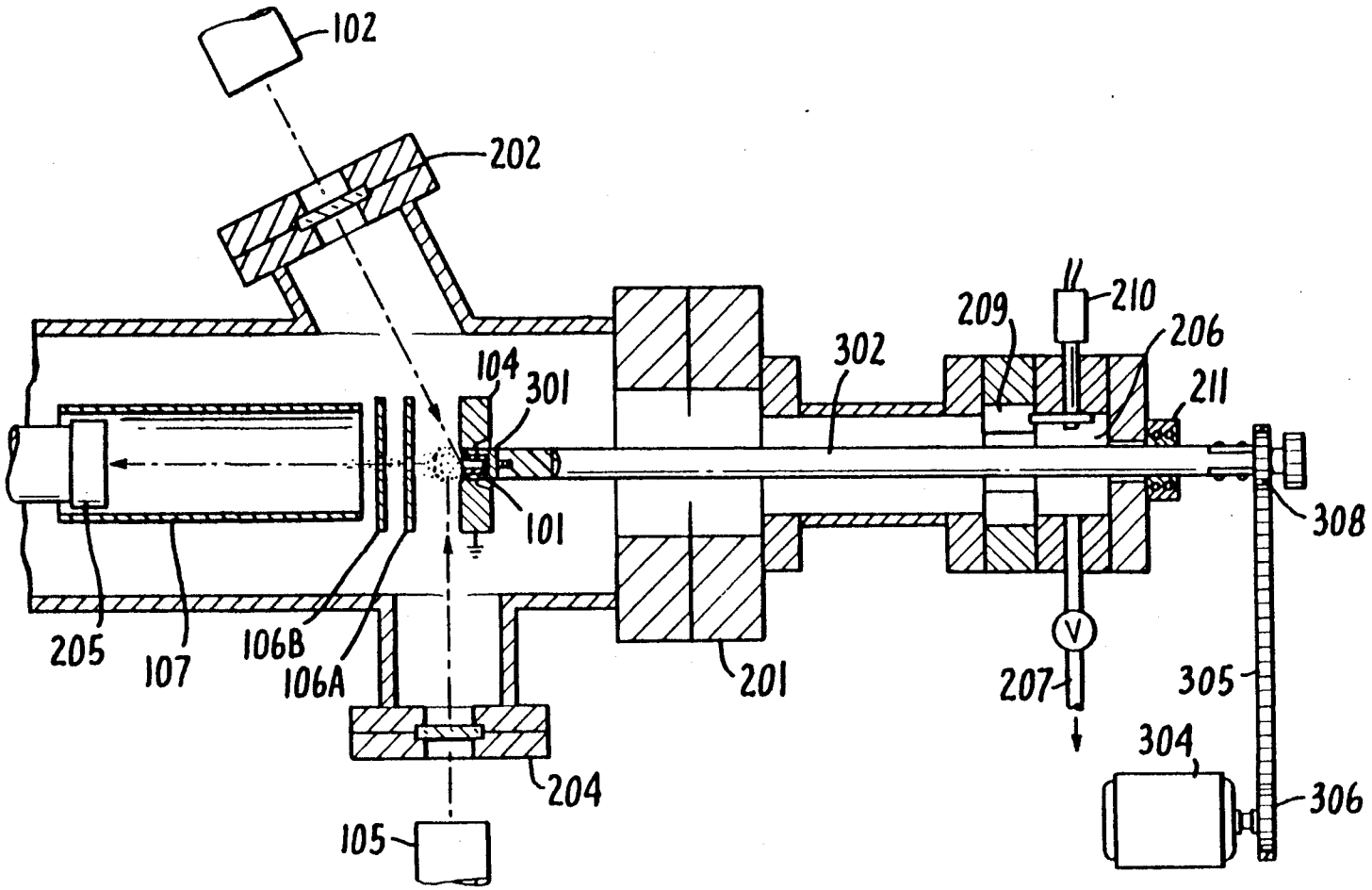
FIG. 3 is a horizontal cross-section of a volatilizer and ion source of this invention with the sample in place.

In FIGS. 2. 3 and 4, more details of this twin laser ion generation system are shown, including vacuum chamber 201 with laser ports 202 and 204. Detector 205 is shown. Chamber 201 is equipped with a vacuum sample introduction chamber 206 which is equipped with seal 211 and is evacuated via vacuum line 207. When the chamber 206 is evacuated as indicated by pressure gauge 210, high vacuum gate valve 209, operated by a solenoid, opens and permits sample carrier 101 to enter the chamber as shown in FIG. 3.

Figure 4:
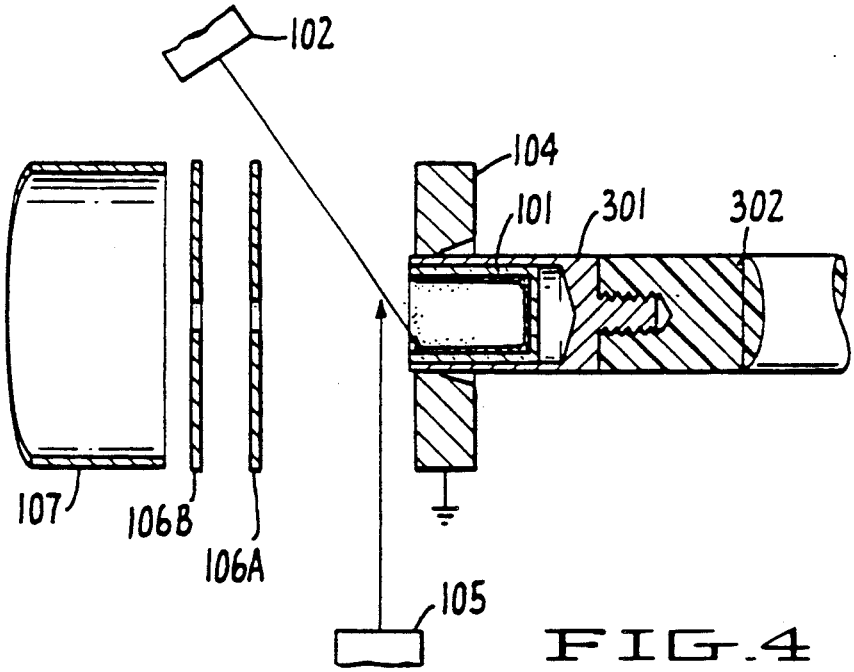
FIG. 4 is an enlargement of the ionization zone of the ion source depicted in FIG. 3.

Sample carrier 101 is depicted as a cylindrical glass cup. It is mounted to a metallic clamp 301 which is in turn attached to the end of an elongated rod 302. (This is best shown in FIG. 4.) This rod is constructed of teflon or any other material which will be inert to the conditions of the ion generation and not interfere with the two laser ionizations and the mass spectral analysis. Seal 211 allows rod 302 to rotate. This in turn permits the beam of laser 102 to strike additional areas of the sample on carrier 101. This rotating of the sample can be done manually, but preferably is carried out mechanically, such as by the action of D.C. motor 304 driving cogged belt 305 on pulleys 306 and 308. Rod 302 can be moved inward and outward, as well, to expose additional areas of the sample on carrier 101 to the desorbing laser beam.

Figure 5A:
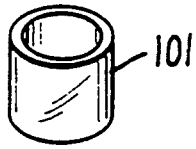
FIG. 5A is a perspective view of a sample holder for use in a volatilizer and ion source of this invention such as the one depicted in FIG. 2.
Figure 5B:
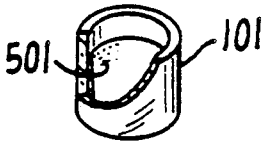
FIG. 5B is a partially cutaway perspective view of the sample holder depicted in FIG. 5A.
Figure 6:
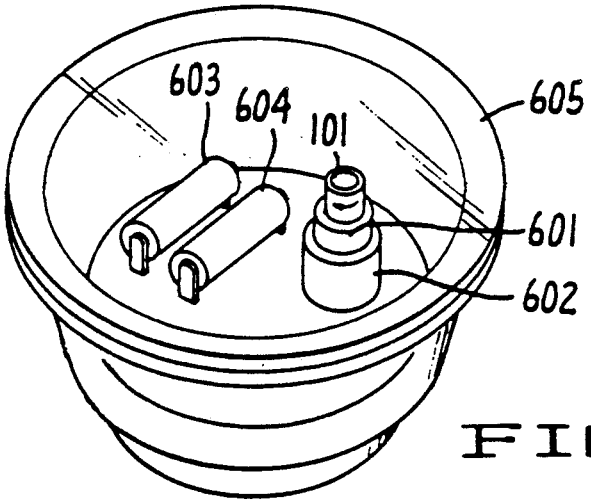
FIG. 6 is a perspective view of a device ancillary to the present invention which can be used to prepare a sample of the configuration shown in FIGS. 2 through 5 for use in the volatilizer and ion source of this invention.

Sample carrier 101 is one favored configuration for introducing samples into the ionizing region. FIGS. 5A. 5B and 6 illustrate the preparation of samples in this configuration. Carrier 101 is cylindrical and is shown about full size in FIGS. 5A and 5B. The sample 501 is placed on the inner inorganic oxidic surface of the carrier 101 as a layer, preferably as a thin layer. One way to do this is shown in FIG. 6. Sample carrier 101 is mounted in fixture 601, which is spun by motor 602. Items 603 and 604 are batteries which power motor 602. A solution or suspension of the sample is controllably introduced into the bottom of carrier 101. As the carrier 101 spins, it carries the sample up the side walls by centrifugal force. The rate of spin and the rate of fluid addition are controlled to achieve coverage of the wall. This apparatus is positioned in a vacuum desiccator 605. This is closed and evacuated with the motor spinning, thereby pulling off the solvent and leaving the sample as a solid deposit on the inorganic oxidic surface provided by carrier 101.

The present invention is not limited to the particular sample configuration embodied in carrier 101. Other sample carrier configurations can be used as long as they provide the required inorganic oxidic support surface and are capable of being positioned in the ion acceleration zone. FIG. 7 shows a variation of the sample carrier in which the sample is deposited on a flat outer surface of inorganic oxidic carrier 701. The use of carrier 701 in the ion generation process is also shown in FIG. 7. Other equivalent designs can be used, if desired.

In the samples just described, a single sample containing one or more heat-labile organic solids is deployed on the carrier: This can be very useful when multiple mass spectra are to be run on the single sample to improve the signal-to-noise ratio, to improve sensitivity, or the like.

Alternatively, the sample carrier can carry a plurality of samples simultaneously with the carrier being moved to bring them serially into the desorbing laser beam. In FIG. 8, a carrier 801 is shown with a spiral of sample 802 on its surface. This spiral of sample could be produced, for example, by delivering the effluent from a microscale chromatography column onto the carrier as a narrow, discrete band. Repeated desorption and ionization of portions of this band would indicate the materials present in the effluent at various elution times.

FIG. 9 illustrates an additional representative sample configuration in which a plurality of separate discrete samples 902*a*, 902*b*, 902*c*, etc. are arrayed on the surface of carrier 901. This could be accomplished by putting individual drops of each sample on the carrier and drying or by providing the sample carrier with separation means to isolate a plurality of sample depots. This configuration can be of special utility in combination with automated analyzers or sequencers, such as peptide and nucleotide sequencers, where a large number of separate samples are generated over a period of time and where knowledge of the contents of all of the samples are needed to complete the analytical result.

FIG. 10 illustrates carrier 1001 having a spiral band of sample 1002 arrayed on its inner surface. This carrier could be used directly in place of carrier 101 and would permit the analysis of a continuous flow sample as described with reference to FIG. 8.

In one preferred application, the ion generator is employed as part of a detector in oligomer sequencers. Such sequencers determine the identity of the links in an oligomer chain. Two common sequencers in use today are peptide sequencers and oligonucleotide sequencers. These identify the amino acid sequence in peptides (e.g., proteins, etc.) and the nucleotide sequence in genetic materials, respectively.

Such sequencers function by repetitively subjecting the oligomer chain to a series of chemical reactions by which the terminal link in the chain is cleaved off and isolated, the next link is cleaved and isolated, etc. until the entire chain has been separated into its component units and the separate units isolated. The various links are isolated per se or as suitable derivatives. As used herein to describe these chemical links in the oligomer chains, the term "unit", as in "amino acid unit" or "nucleotide unit", is defined to encompass the underlying amino acid or nucleotide or the like as well as derivatives thereof.

In the two common cases just set forth, the individual amino acid units or nucleotide units can be presented separately or serially on the inorganic substrate. Thus, a series of individual samples can be used or samples can contain two or more of the separated materials as described with reference to FIGS. 8, 9, and 10. The samples can be inserted into the two laser ion generator and the ions generated therefrom can be identified in a mass spectrometer and compared with known ion distributions determined with standards.

A widely used peptide-sequencing methodology is the so-called "Edman degradation chemistry" described in Edman, p., Begg, G., *Eur. J. Biochem.* 1967, 1 80, which is incorporated herein by reference. This chemistry generates and isolates the individual amino acids as phenylthiohydantion derivatives ("PTH-amino acids").

The invention will be further described by the following Examples. These are provided as illustrations of the invention and are not to be construed as limiting its scope.

EXAMPLES

EXAMPLE 1

Experimental Set Up

A two-laser ion source is constructed substantially as shown in FIGS. 2, 3 and 4. The source is coupled to a TOF mass spectrometer in a vacuum system. The extraction field of the TOF mass spectrometer is 130 V/cm, the (second) acceleration field is 400 V/cm, the drift tube is at $-1.4$ kv, and the mean flight path is 0.3 m. MacClaren conditions are achieved in the mass spectrometer. The vacuum system consists of a small standard turbo pump (50 l/s), which exhausts a six-port 4-inch stainless-steel cross. With the help of two additional liquid $N_2$ traps, the residual pressure does not exceed $10^{-6}$ Torr during the various experiments. A pulsed $CO_2$ laser (pulse Systems Lp 30; 10 Hz, multiline, $\lambda \simeq 10.6$ $\mu$m) with internally mounted aperture (10 mm diam.) is focussed by a ZnSe lens (f=250 mm) onto the inner surface of a rotatable inorganic oxide sample carrier (glass cup) under a 45° angle. The cup is placed in the center of the first electrode of the TOF mass spectrometer. The desorbed molecules in an expanding cloud directed toward the axis of the TOF mass spectrometer are irradiated at right angles by a frequency-quadrupled Nd:YAG laser (Quanta Ray) of 266 mm. In most of the experiments the Nd:YAG laser is slightly focussed by a quartz lens to a diameter of 6 mm resulting in a power density of about $10^6$ W/cm$^2$ in the ionization volume. The laser pulse width is 10 ns, which is very suitable for TOF analyses. The timing of the various events is as follows: A first pulse from the Nd:YAG laser clock with an appropriate delay and amplification triggers the $CO_2$ laser A second pulse from a fast photodiode irradiated by the Nd:YAG laser pulse triggers an oscilloscope and the data acquisition system. The ions are formed in the acceleration region of the linear TOF mass spectrometer and are then detected and analyzed by an ion current measurement (ORTEC. Model 9301 and 474). with a 21-stage CuBe electron multiplier. The signals are stored and further processed by a wave form recorder (LeCroy. Model 9400) and plotted. A complete mass spectrum is obtained for each $CO_2$/Nd:YAG laser shot in a few microseconds. Most of the spectra obtained and represented here are the average of 100 laser pulses ($\sim$10 s). Table 1 presents the main operating parameters. The fixed laser fluences are reported together with the TOF mass spectrometer characteristics.

Reagents and Sample Preparation

The chemicals used in these experiments are obtained from Sigma Chemical Company and Pierce Chemical Company and used without further purification. PTH-arginine and PTH-cysteic acid are obtained from commercially available salts by treatment with NaOH and HCl, respectively, followed by extraction with ethyl acetate. Samples are generally dissolved in ethyl acetate and diluted to provide the different PTH-amino acids (or mixtures containing different PTH-amino acids) at known concentrations. Application of a given volume (usually 100 $\mu$l) of the various dilutions to the sample cup while rotating gives a convenient sample size of each PTH-amino acid for quantitative measurements. PTH-amino acid and solvent additions are made via a thin tube which delivers the solution at the bottom of the glass cup. As the solution emerges from the tube, it is spun by centrifugal force onto the wall and spread out as a thin film over the inner surface. Volume of liquid for a given time is metered so that the level is sufficient just to cover the inner surface. A vacuum is applied to remove the solvent leaving a dry PTH-amino acid film. The thickness of the samples varied from hundreds of monolayers—easily visible by eye—to $10^{-3}$ monolayers. One monolayer of the sample molecules on the glass substrate corresponds to about 10 picomoles in the desorbing $CO_2$ laser area of 0.01 cm$^2$. After evaporation of the solvent, the glass cup is mounted onto a $\frac{1}{2}$ inch diameter teflon rod and introduced into the TOF mass spectrometer through one of the vacuum locks as shown in FIGS. 2 and 3. In order to prevent the main vacuum system from being directly exposed to the atmosphere when the sample is introduced into the system, a small rough-vacuum chamber, as shown in FIGS. 2 and 3 is used. The volume of this chamber is about 20 cm$^3$. It is equipped with a high-vacuum gate valve. It allows the mass spectra to be taken immediately after introducing the sample.

Results

Figure 11:
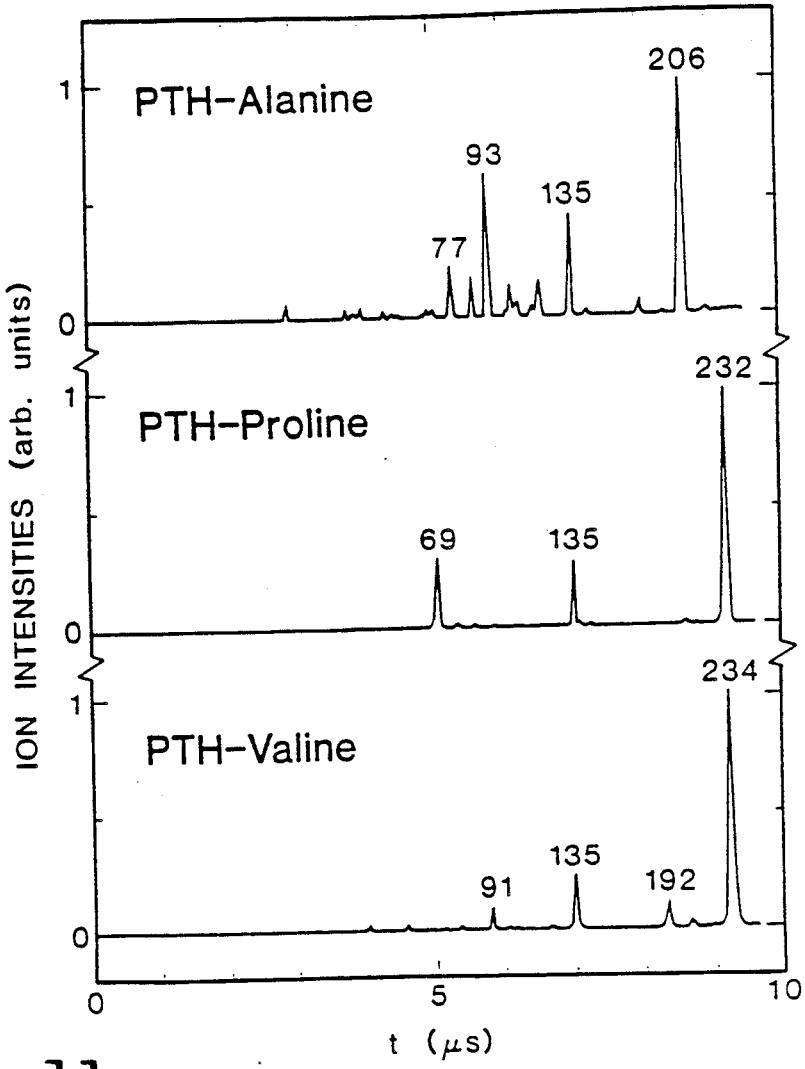
FIG. 11 is a time-of-flight mass spectrograph of three separate different amino acid derivatives (phenylthiohydantion or "PTH" amino acids) employing an ion source of this invention.
Figure 12:
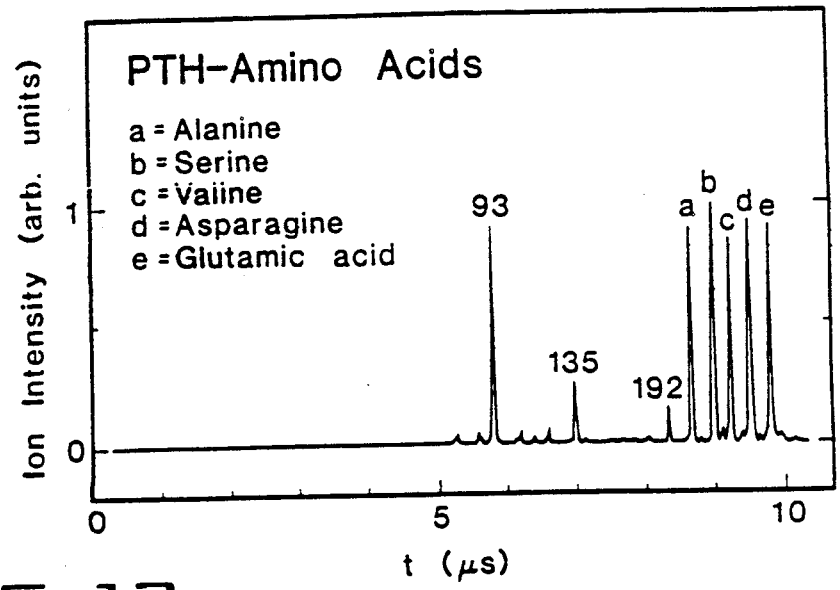
FIG. 12 is a time-of-flight mass spectrograph of an equimolar mixture of five PTH amino acids employing an ion source of this invention.

Typical laser desorption/multiphoton ionization mass spectra obtained in the above manner for three different PTH-amino acids are shown in FIG. 11. The main features are: (i) a high yield of the parent ion peak. (ii) little degree of fragmentation and chemically simple fragmentation paths, i.e., elimination of stable neutral molecules; the remaining fragment ions still act as a 'fingerprint', and (iii) the REMPI considerably reduces the background signal in contrast to EI, CI, and SIMS, resulting in nearly flat baselines. The spectra shown in FIG. 11, are typical for all PTH-amino acids obtained with sample amounts in the subnanomole range. Table 2. presents the results obtained with twenty PTH-amino acids. For each PTH-amino acid the dominant mass peak (base peak). the abundance of the parent ion peak, and major fragment ions with relative abundance to base peak are reported. It can be seen from Table 2. that the major fragment pathways yield mass peaks of 192, 135, 93, 91, and 77. FIG. 12 shows a typical mass spectra of an equimolar mixture of five PTH-amino acids. The advantage of lower ionizing laser fluence is clearly visible, since the five different PTH-amino acids tested could be completely resolved with the low resolution TOF mass spectrometer. Moreover, the parent ion signals of all five PTH-amino acids are of comparable size.

Even for PTH-amino acids with the same molecular weight, for example, PTH-leucine and PTH-isoleucine, the fragmentation pattern allows one to distinguish isomers (see Table 2). This is in sharp contrast with the results reported with electron impact ionization (Hagenmaier, H., Ebbighausen, W., Nicholson, G., Votsch, W., *Z. Naturforsch,* 1970, 25*b*, 681) and chemical ionization (Fales, H.M., Nagai, Y., Milne, G.W.A., Brewer, H.B., Jr., Bronzert, T.J., Pisano, J.J., *Anal. Biochem,* 1971, 43, 288). Moreover, the fragmentation pattern is unique to the PTH-amino acid at low fluences. This has the advantage of allowing identification of PTH-amino acids whose parent ion is nearly absent (see, for example, PTH-lysine and PTH-cysteic acid in Table 2).

In a series of further experiments, the time delay between the desorbing $CO_2$ laser and the ionizing Nd:YAG laser is varied to allow measurement of arrival time distributions of the desorbed species. The timing sequence for this kind of measurement needs some description. Briefly the 'lamp out' from the Nd:YAG laser serves as the master clock for the timing sequence. After a variable delay (0–300 $\mu$s) the $CO_2$ laser is triggered. A NaCl beamsplitter and a fast photodiode serve to measure the time of arrival of the 10 $\mu$s pulse from this laser which typically arrives $9\pm1$ $\mu$s (function of the input voltage) after the delay generator trigger pulse. The $CO_2$ laser beam size at the sample is $\sim$0.01 $cm^2$ and pulse energies of $\sim$50 mJ are used, pulses from the Nd:YAG laser (typically 1 mJ 10 ns) arrive after a variable delay and are focused (0.1 cm diameter beam waist) through the ionization region of the TOF mass spectrometer. The Nd:YAG laser beam (266 nm) is propagated 1.2 cm from and parallel to the electrode surrounding the rotating glass cup. An oscilloscope is used to observe simultaneously the arrival of the $CO_2$ desorption laser pulse, the arrival of the Nd:YAG ionization laser pulse, and the ion signal.

Figure 13:
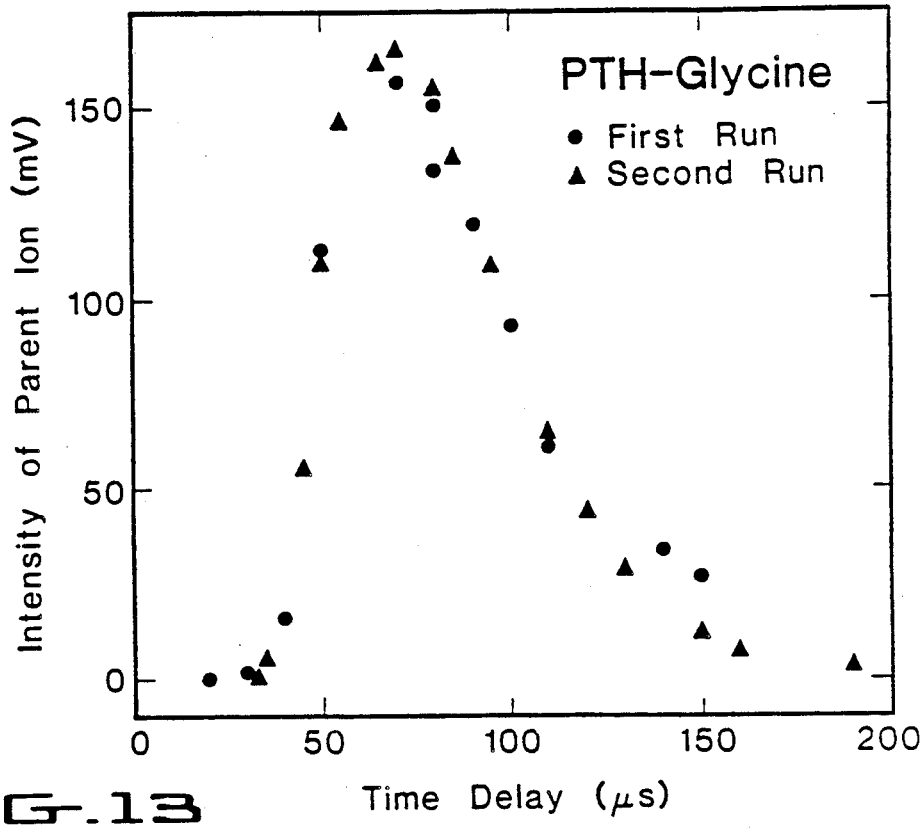
FIG. 13 is a graph illustrating the velocity distribution of a PTH amino acid in a mass spectrometer using an ion source of this invention.

A typical experiment (see FIG. 13) shows the dependence of the m/e=192, parent ion) signal on the time delay between the desorption and ionization pulses. The data points—two different runs from different PTH-glycine samples of the same sample film thickness—represent a 100 shot average at each delay for the first run, whereas in the second run they represent a single shot at a given delay time. The film thickness of the sample is about ten monolayers. Similar curves are been measured for other PTH-amino acids with different sample film thicknesses ranging from hundreds of monolayers to submonolayer coverage; they allow interpretation of the mean arrival time as well as the velocity distributions, i.e., kinetic energy distributions of neutral molecules. This in turn gives first insight into the desorption process. Furthermore, the method of detection employed herein (MPI) like other laser methods (LIF) is carried out in general by a density detector, whereas desorption rates, like reaction rates, are always related to flux. Knowledge of the velocity distribution. i.e., the mean velocity for a given delay time, allows one to determine the flux of molecules through the ionization volume.

Following the treatment of Nogar. Estler, and Miller (*Anal. Chem.* 1985, 57, 2441). the velocity distribution is obtained directly from FIG. 13. In the case of PTH-glycine the center-of-mass velocity is $165\pm5$ $ms^{-1}$ and the 'thermal' velocity is $177\pm7$ $ms^{-1}$ nearly independent of both the desorption $CO_2$ laser fluences (50–200 $mJ/cm^2$) and the thickness of the sample film. The 'thermal' Velocity distribution is characterized by a width of $180\pm30$ $ms^{-1}$, corresponding to "temperature" slightly above room temperature. i.e., $350° K \leqq T \leqq 450° K$. Although near-thermal distributions seem to be the norm at least for physisorbed molecules, nonthermal distributions have also been previously observed.

The efficiency of this process and its ability to completely desorb samples under mild conditions is further demonstrated by the following observations. PTH-serine and PTH-threonine are known to dehydrate upon heating above 400° K. However, in these experiments ions with m/e of 204 and 218 are never observed, in contrast to electron bombardment and chemical ionization mass spectrometry. This result indicates that desorbed PTH-amino acids escape the substrate rapidly at low temperatures, giving a clue about the presently unknown nature of the laser desorption mechanism.

Figure 14:
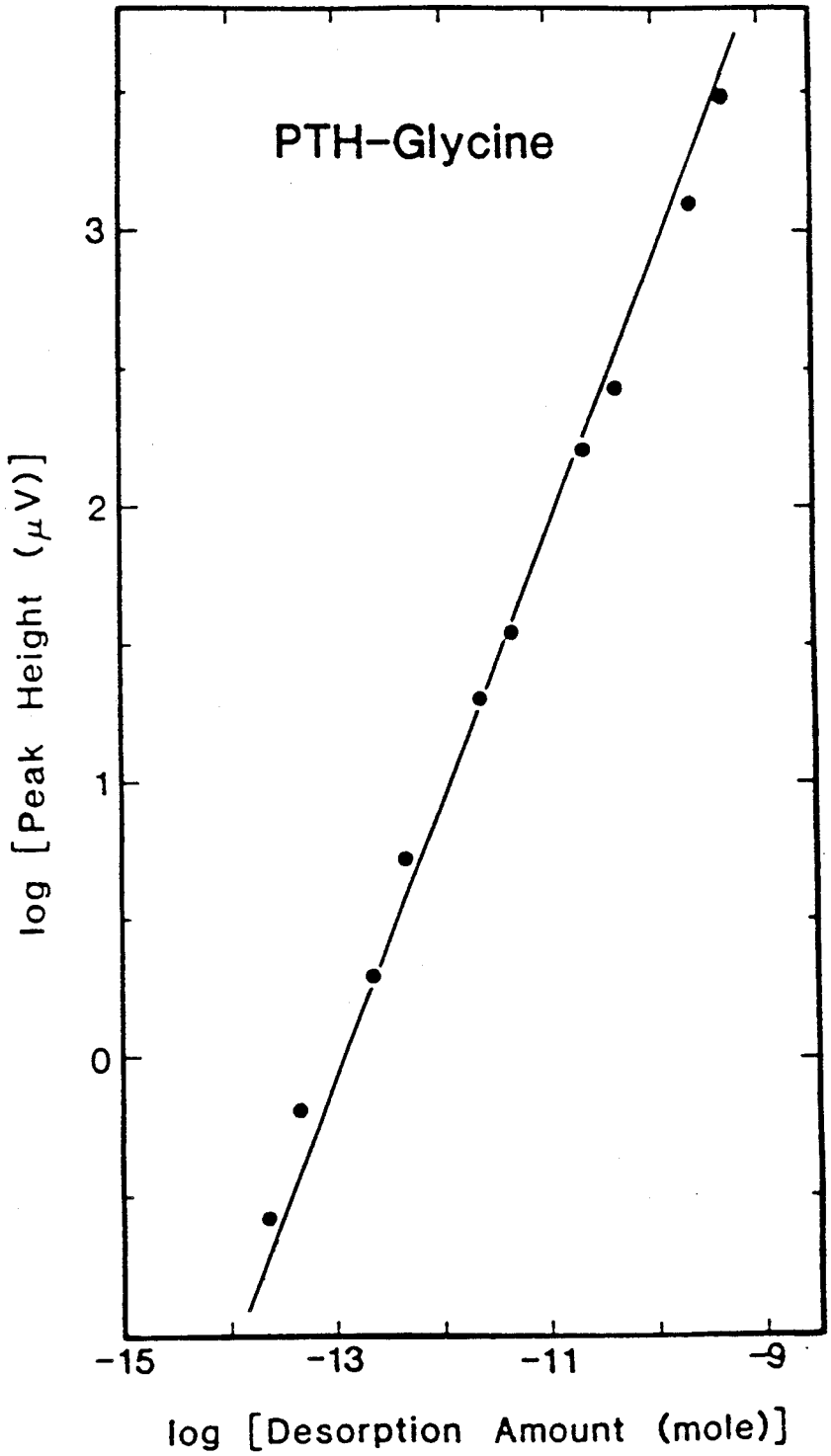
FIG. 14 is a graph illustrating the linearity of mass spectrometer response over a range of PTH amino acid sample size of five orders of magnitude when employing an ion source of this invention.

The system of this invention can function as an instrument for quantitative analysis of solid organic samples. The linearity of response as a function of sample concentration is investigated using PTH-glycine with fixed $CO_2$ laser power of 500 $kW/cm^2$, fixed Nd:YAG laser power of 1 $MW/cm^2$, and fixed time delay between $CO_2$ laser pulse and Nd:YAG laser pulse ($\sim$70$\mu$). The results are shown in FIG. 14 where the maximum output signal for the parent ion corresponding to the peak height given in mV, is plotted against the desorption rate per pulse. The PTH-glycine concentration ranges over five orders of magnitude between nanomoles and femtomoles. From FIG. 14 it should be noted that the linearity of the graphs covers more than five orders of magnitude of concentration of PTH-glycine. The upper limit is due to (a) the nonlinear response of the multiplier and (b) the incomplete desorption of the sample, while the lower limit of about $10^{-14}$ mole corresponds to a $S/N \simeq 1$ in the analog ion current measurement. It can be demonstrated that the desorption is complete within the concentration range given in FIG. 14, by observing the reduction of mass spectra signal by orders of magnitude in the second rotation on the same circle of a glass cup. With an estimated, ionization volume of about $2\times10^{-4}$1, based on the geometry of the Nd:YAG laser and the TOF mass spectrometer electrodes, about 1 femtomole can be detected easily with a satisfactory S/N ratio.

EXAMPLE 2

The experiments of Example 1 are repeated with different nonvolatile organic solids:

For the molecules studied. e.g., protoporphyrin IX dimethyl ester, $\beta$-estradiol, and the four bases of DNA, the mass spectra obtained are dominated by the parent ion peak. Moreover, the ion signal is found to be linear with surface coverage over more than five orders of magnitude from nanomole to subfemtomole amounts per new target area exposed by consecutive laser shots. A detection limit (S/N=2) of $4\times10^{-17}$ moles of protoporphyrin IX dimethyl ester, corresponding to $\sim 10^{-5}$ of a monolayer, is obtained.

In the desorption step, the pulsed output of a $CO_2$ laser (10.6μ; 10 mJ/pulse; 10 μs pulse width; 10 Hz repetition rate) is directed onto a nearly uniform, thin film of the sample deposited on the inner surface of a rotating glass cup or tube. Neutral molecules escape from the surface in the rapid laser-induced thermal desorption process. The heating rate is rapid enough ($10^{8°}$ K/s) that internally lukewarm molecules are desorbed, even though more traditional heating rates (10° K/s or less) cause extensive molecular decomposition on the surface. After an appropriate time delay (70–90 μs), the fourth harmonic (266 nm) of a Nd:YAG laser ($\sim$1 mJ/pulse; 10 ns pulse width; 10 Hz repetition rate) causes 1+1 resonance-enhanced multiphoton ionization (REMPI) of the desorbed molecules in an interaction region located about 1 cm from the surface. The glass cup or tube forms part of the first electrode (repeller plate) of a linear (30 cm) time-of-flight mass spectrometer. The ions are detected by an electron multiplier with two preamplifiers (EG&G ORTEC Model 9301 and 474) which feed a transient digitizer (LeCroy 9400) so that the entire mass spectrum can be recorded from a single laser shot. Typically, an average of over two hundred laser shots is taken. From the spectrum is subtracted a "gas-phase background spectrum" obtained with the desorption laser off.

The protoporphyrin IX dimethyl ester. β-estradiol, and adenine were obtained from Sigma Chemical Company and were used without further purification. Chloroform solutions are placed inside the spinning glass cup or tube and the solvent is removed under a rough vacuum ($10^{-1}$ Torr).

Typical laser desorption/multiphoton ionization mass spectra of protoporphyrin IX dimethyl ester, β-estradiol, and adenine are shown in FIG. 15. In each case the spectrum shows almost exclusively the parent ion, indicating that fragmentation is negligible. A calculated detection limit (S/N=2) of $4\times10^{-17}$ moles is obtained for protoporphyrin IX dimethyl ester. These results demonstrate the ultra-high sensitivity of our methodology.

The linear dependence of signal on sample concentration was investigated with fixed $CO_2$ laser power (50 kW/cm²), fixed Nd:YAG laser power (300 kW/cm²) and fixed time delay (70–90μ, depending on the molecule) between $CO_2$ laser pulse and Nd:YAG laser pulse. The results for protoporphyrin IX dimethyl ester, β-estradiol, and adenine are shown in FIG. 16 where the parent ion peak height is plotted against the desorption amount per $CO_2$ laser pulse. The sample concentration ranges from nanomoles to subfemtomoles. It should be noted that the linearity covers more than five orders of magnitude of sample concentration. The complete description by the $CO_2$ laser has been demonstrated within the concentration range given in the figure. In contrast to other mass spectrometric methods for the analysis of molecular adsorbates, the ability of the present two-step laser method to cover so wide a dynamic range of quantitation appears to be unprecedented.

These experiments demonstrate that by using the present invention quantitative analysis of femtomoles or less of molecules adsorbed on surfaces by LD/REMPI is possible. As will be appreciated by those of skill in the art, there is the possibility of lowering the detection limit orders of magnitude below the present level by conventional improvements in the elementary electronics and ion optics.

TABLE 1

| Typical Operating Parameters | |
|---|---|
| $CO_2$ laser fluence ($\lambda$ = 10.6 μM, $\tau_P$ = 10 μ5) | $\lesssim$200 mJ/cm² |
| Nd:YAG laser fluence (frequency quadrupled, $\lambda$ = 266 nm, $\tau_p$ = 10 ns) | $\lesssim$1 mJ/cm² |
| acceleration voltage | 1.6 kV |
| multiplier voltage | 2 kV – 3 kV – 4 kV |
| gain | $2\times10^4 - 2\times10^5 - 1\times10^6$ |
| TOF mass spectrometer resolution | 80 (10% valley) |
| pressure inside TOF mass spectrometer | $<10^{-6}$ Torr |
| probe rotation | $2\pi/90\ s^{-1}$ |
| duty cycle | 10 Hz |

TABLE 2

Main Fragments in the Mass Spectra of PTH-Amino Acids

| PTH-amino acids | MW | relative abundance of M⁺ (%) | base peak (m/e) | major fragment peaks (relative abundance to base peak in %) |
|---|---|---|---|---|
| glycine | 192 | 100 | 192 | |
| alanine | 206 | 100 | 206 | 93(60),135(42),77(22),87(17) |
| serine | 222 | 100 | 222 | 135(27),192(16),92(13),77(12) |
| proline | 232 | 100 | 232 | 69(30),135(26) |
| valine | 234 | 100 | 234 | 135(18),192(12) |
| threonine | 236 | 100 | 236 | 192(56),91(25),43(17),135(16) |
| leucine | 248 | 100 | 248 | 135(40),219(13),192(12),43(10) |
| isoleucine | 248 | 100 | 248 | 192(40),135(33),57(17) |
| asparagine | 249 | 100 | 249 | 91(18),135(10) |
| aspartic acid | 250 | 100 | 250 | 135(21),91(17),85(17),119(11) |
| glutamine | 263 | 79 | 93 | 93(100),205(22),59(22),192(13) |
| glutamic acid | 264 | 100 | 264 | 135(15) |
| methionine | 266 | 100 | 266 | 192(23),205(21),135(10) |
| histidine | 272 | 100 | 272 | 81(49),153(24),95(18),192(10) |
| phenylalanine | 282 | 81 | 91 | 91(100),131(98) |
| cysteic acid | 286 | 27 | 91 | 91(100),204(25),135(17),69(14) |
| arginine | 291 | 78 | 93 | 93(100),71(86),29(11) |
| tyrosine | 298 | 43 | 107 | 107(100),192(74) |
| tryptophan | 321 | 36 | 130 | 130(100),64(43),114(29),87(21) |
| lysine | 398 | 4 | 93 | 93(100),305(72),69(50),26(30) |

What is claimed is:

1. A method for generating a quantitatable burst of volatilized molecules of a nonvolatile solid organic material comprising the steps of a. providing the solid organic material as a physisorbed deposit upon a nonporous, inorganic oxide, solid support surface, and b. striking a controlled area of the deposit with a laser pulse adequate to essentially completely desorb off of the support surface that portion of the deposit struck by the laser pulse, with the laser pulse and the nature of the support surface being selected and related to provide a rate of heating of the support surface struck by the laser pulse of at least $10^{6°}$ K/sec without volatilization, decomposition or ionization of the support.

2. The method of claim 1 wherein the deposit has a controlled thickness of from about $10^{-5}$ monolayers to about $10^3$ monolayers.

3. The method of claim 2 wherein the support surface has a reflectivity not greater than 0.3 at the wavelength of the laser pulse.

4. The method of claim 3 wherein the support has a thermal conductivity not greater than 0.5 J/cm·sec·°K, and a thermal diffusivity not greater than 0.1 $cm^2$/sec.

5. The method of claim 4 wherein the laser pulse has a wavelength of from about 0.5 to about 30 μm, an intensity of from about 50 to about 1000 mJ/$cm^2$ and wherein the rate of heating of the support surface by the laser pulse of at least $5\times10^{6°}$ K/sec.

6. The method of claim 5 wherein the inorganic oxide is vitreous.

7. The method of claim 6 wherein the inorganic oxide is glass.

8. The method of claim 7 wherein the inorganic oxide is silanized glass.

9. The method of claim 5 wherein the inorganic oxide is ceramic.

10. A method for quantitating a nonvolatile organic material in a sample containing the same comprising the steps of:

a. providing the organic material as a physisorbed solid deposit of the sample upon a nonporous, inorganic oxide, solid support surface, b. placing the solid deposit on the support surface in a vacuum, c. striking a controlled area of the deposit with a first laser pulse, said first laser pulse being of a predetermined wavelength, intensity and duration adequate to essentially completely desorb off of the support surface as molecules that portion of the deposit struck by it and thereby give rise to a cloud of gaseous molecules of the organic material but also being such as not to bring about ionization of said molecules, with the first laser pulse and the nature of the support surface being selected and related to provide a rate of heating of the support surface struck by the first laser pulse of at least $10^{6°}$ K/sec without volatilization, decomposition or ionization of the support, d. after a controlled time interval, passing through the cloud of gaseous molecules a second laser pulse, said second laser pulse being noncoaxial with the first laser pulse, being directed adjacent to but not in contact with the deposit on the support surface, and being selected of a predetermined wavelength, intensity and duration adequate to effect resonance enhanced multiphoton ionization of a portion of said gaseous molecules which it strikes, thereby producing a burst of gaseous ions.

e. detecting the ions so generated, and f. relating the ions so detected to the amount of nonvolatile organic material present in the sample.

11. The method of claim 10 wherein the deposit has a controlled thickness of from about $10^{-5}$ monolayers to about $10^3$ monolayers.

12. The method of claim 11 wherein the support surface has a reflectivity not greater than 0.3 at the wavelength of the first laser pulse, a thermal conductivity not greater than 0.5 J/cm·sec·°K, and a thermal diffusivity not greater than 0.1 $cm^2$/sec.

13. The method of claim 12 wherein the inorganic oxide is vitreous material.

14. The method cf claim 13 wherein the inorganic oxide is glass.

15. A method for quantitating a nonvolatile organic material in a sample containing the same comprising the steps of:

a. providing the organic material as a solid deposit of the sample upon a nonporous solid inorganic oxidic surface, b. placing the solid deposit on the inorganic oxidic surface in a vacuum, c. striking a controlled area of the deposit in the vacuum with a first laser pulse, said first laser pulse being selected of a predetermined wavelength, intensity and duration adequate to essentially completely desorb off of the inorganic oxidic surface as molecules that portion of the deposit struck by it and give rise to a cloud of gaseous molecules of the organic material but also such as not to bring about ionization of said molecules, d. after a controlled time interval, passing through the cloud of gaseous molecules a second laser pulse, said second laser pulse being noncoaxial with the first laser pulse, being directed adjacent to but not in contact with the deposit on the inorganic oxidic surface, and being selected of a predetermined wavelength, intensity and duration adequate to effect resonance enhanced multiphoton ionization of a portion of said gaseous molecules which it strikes, thereby producing a burst of gaseous ions, e. detecting the ions so generated, and f. relating the ions so detected to the amount of nonvolatile organic material present in the sample.

16. The method of claim 15 wherein the deposit has a known thickness of from about $10^{-5}$ monolayers to about $10^3$ monolayers.

17. The method of claim 16 wherein the inorganic oxidic surface comprises glass.

18. A method for generating a quantitatable burst of gaseous ions of a nonvolatile solid organic material comprising the steps of a. providing the solid organic material as a controlled thickness physisorbed deposit upon a nonporous, inorganic oxide, solid support surface, and b. striking a controlled area of the deposit with a first laser pulse adequate to essentially completely desorb off of the support surface as gaseous molecules that portion of the deposit struck by the first laser pulse, with the first laser pulse and the nature of the support surface being selected and related to provide a rate of heating of the support surface struck by the first laser pulse of at least $10^{6°}$K/sec without volatilization, decomposition or ionization of the support, and c. thereafter, ionizing a reproducible fraction of the gaseous molecules, thereby producing the quantitatable burst of gaseous ions.

19. The method of claim 18 wherein the deposit has a controlled thickness of from about $10^{-5}$ monolayers to about $10^3$ monolayers and wherein the support surface has a reflectivity not greater than 0.3 at the wavelength of the first laser pulse, a thermal conductivity not greater than 0.5 J/cm·sec·°K, and a thermal diffusivity not greater than 0.1 $cm^2$/sec.

20. The method of claim 19 wherein the ionization is effected by, after a controlled time interval, passing through the cloud of gaseous molecules a second laser pulse, said second laser pulse being noncoaxial with the first laser pulse, being directed adjacent to but not in contact with the deposit on the inorganic oxidic surface, and being selected of a predetermined wavelength, intensity and duration adequate to effect resonance enhanced multiphoton ionization of a portion of said gaseous molecules which it strikes.

21. A method for generating a burst of gaseous ions of a solid organic material for resolution in a mass spectrometer comprising the steps of a. providing the solid organic material as a physisorbed deposit upon an nonporous, inorganic oxide, support surface, b. positioning the deposit of solid material within the ion acceleration zone of the mass spectrometer in or adjacent to one accelerator pole of said zone.

c. striking a controlled area of the deposit with a first laser pulse adequate to desorb off of the support surface as gaseous molecules that portion of the deposit struck by said first laser pulse, with said first laser pulse and the nature of the support surface being selected and related to provide a rate of heating of the support surface struck by the laser pulse of at least $10^{6°}$ K/sec without volatilization, decomposition or ionization of the support, and d. after a controlled time interval, passing through the cloud of gaseous molecules a second laser pulse, said second laser pulse being noncoaxial with the first laser pulse, being directed adjacent to but not in contact with the deposit on the inorganic oxidic surface, and being selected of a predetermined wavelength, intensity and duration adequate to effect resonance enhanced multiphoton ionization of a portion of said gaseous molecules which it strikes, thereby producing the burst of gaseous ions within the ion acceleration zone.

22. The method of claim 21 wherein the deposit comprising the organic material is of known thickness, the first laser pulse is adequate to essentially completely desorb off of the support surface as molecules that portion of the deposit struck by the laser pulse, and the burst of gaseous ions is a quantitable burst of ions.

23. In a method for generating a burst of gaseous ions of a solid organic material comprising the steps of a. providing the solid organic material as a deposit on a support surface, b. striking the deposit with a pulse of a first laser to desorb the deposit of the support surface and give rise to a cloud of gaseous molecules of the organic material, and c. thereafter passing through the cloud of gaseous molecules a beam of a second laser to effect ionization of a portion of the gaseous molecules which it strikes, thereby producing the burst of gaseous ions;

the improvement comprising employing the deposit as a physisorbed deposit on the non-porous, inorganic oxide, solid support surface.

24. In the method of claim 23, the further improvement of providing the solid organic material as a deposit of a known thickness of from about $10^{-5}$ monolayers to about $10^3$ monolayers.

25. In a method for generating a burst of gaseous ions of a nonvolative solid organic material comprising the steps of a. providing the nonvolatile solid organic material as a deposit upon a support surface, b. striking the deposit with a pulse of a first laser to desorb the deposit off of the surface and give rise to a cloud of gaseous molecules of the organic material, and c. thereafter passing through the cloud of gaseous molecules a beam of a second laser to effect ionization of a portion of the gaseous molecules which it strikes, thereby producing the burst of gaseous ions;

the improvement comprising employing as the support surface a non-porous, inorganic oxide, solid surface upon which the organic material physisorbs and employing as the pulse of the first laser a laser pulse related to the support surface to provide a rate of heating of the support surface struck by the laser pulse of at least $10^{6°}$ K per second without volatilization, decomposition or ionization of the support surface and thereby giving rise to the gaseous molecules as molecules of the nonvolative organic material.

26. In a method for generating a burst of gaseous ions of a solid organic material comprising the steps of a. providing the solid organic material as a deposit on a non-porous, inorganic oxide, solid support surface, b. striking the deposit with a pulse of a first laser to desorb the deposit off of the surface and give rise to a cloud of gaseous molecules of the organic material, and c. thereafter passing through the cloud of gaseous molecules a beam of a second laser to effect ionization of a portion of the gaseous molecules which it strikes, thereby producing the burst of gaseous ions;

the improvement comprising employing as the beam of the second laser a pulse of the second laser and timing the pulse to contact the largest fraction of the gaseous molecules.

27. In a method for generating a burst of gaseous ions of a solid organic material comprising the steps of a. providing the solid organic material as a deposit on a surface.

b. striking the deposit with a first laser pulse to desorb the deposit off of the surface and give rise to a cloud of gaseous molecules of the organic material, and c. thereafter passing through the cloud of gaseous molecules a beam of a second laser to effect ionization of a portion of the gaseous molecules which it strikes, thereby producing the burst of gaseous ions;

the improvement comprising rendering the burst of gaseous ions quantitatable by employing an nonporous inorganic oxidic, solid surface as the surface, by providing the solid organic material as a physisorbed deposit of a known thickness of from about $10^{-5}$ monolayers to about $10^3$ monolayers; by employing as the first laser pulse a pulse selected of a predetermined wavelength, intensity and duration to desorb off of the surface as molecules that portion of the deposit struck by the laser pulse and give rise to a cloud of gaseous molecules of the organic material but also such as not to bring about ionization of said molecules, and by employing as the beam a second laser pulse noncoaxial with the first laser pulse, being directed adjacent to but not in contact with the deposit on the inorganic oxidic surface, and being selected of a predetermined wavelength, intensity and duration adequate to effect resonance-enhanced multiphoton ionization of a portion of said gaseous molecules which it strikes.

28. A laser volatilizer for generating a quantitatable burst of volatilized molecules of a nonvolatile solid organic material comprising a. a nonporous, inorganic oxide, solid support surface upon which the solid organic material can be deposited as a physisorbed deposit, and b. means for striking a controlled area of the deposit with a laser pulse adequate to essentially completely desorb off of the support surface that portion of the deposit struck by the laser pulse, with the laser pulse and the nature of the support surface being selected and related to provide a rate of heating of the support surface struck by the laser pulse of at least 10° K/sec without volatilization, decomposition or ionization of the support.

29. The laser volatilizer of claim 28 wherein the support comprises inorganic oxide having a thermal conductivity not greater than 0.5 J/cm·sec·°K, and a thermal diffusivity not greater than 0.1 $cm^2$/sec and a surface reflectivity not greater than 0.3 at the wavelength of the laser pulse and wherein the laser pulse has a wavelength of from about 0.5 to about 30 μm, and an intensity of from about 50 to about 1000 mJ/$cm^2$ and additionally comprising a vacuum enclosure surrounding the support surface.

30. The laser volatilizer of claim 29 wherein the inorganic oxide is glass.

31. A system for quantitating a nonvolatile organic material in a sample containing the same comprising:

a. a nonporous, inorganic oxide, solid support surface upon which the organic material can be provided as a physisorbed solid deposit of the sample.

b. a vacuum chamber into which the solid deposit on the support surface can be placed, c. means for striking a controlled area of the deposit in the vacuum with a first laser pulse, this pulse being selected of a predetermined wavelength, intensity and duration adequate to essentially completely desorb off of the inorganic oxidic surface as molecules that portion of the deposit struck by the first laser pulse and give rise to a cloud of gaseous molecules of the organic material, but also such as not to bring about ionization of said molecules, with the first laser pulse and the nature of the support surface being selected and related to provide a rate of heating of the support surface struck by the first laser pulse of at least $10^{6°}$ K/second without volatilization, decomposition or ionization of the support, d. means for passing through the cloud of gaseous molecules a second laser pulse, said second laser pulse being at a controlled time interval after the first laser pulse and being noncoaxial with said first laser pulse, being directed adjacent to but not in contact with the deposit on the inorganic oxidic surface, and being selected to be of a predetermined wavelength, intensity and duration adequate to effect resonance enhanced multiphoton ionization of a portion of said gaseous molecules which it strikes, so as to produce a burst of gaseous ions of said molecules, e. means for detecting the ions so generated, and f. means for relating the ions so detected to the amount of nonvolatile organic material present in the sample.

32. A system for quantitating a nonvolatile organic material in a sample containing the same comprising:

a. a nonporous, inorganic oxidic solid support surface upon which the organic material can be provided as a solid deposit of the sample, b. a vacuum chamber into which the solid deposit on the inorganic oxidic surface can be placed, c. means for striking a controlled area of the deposit in the vacuum with a first laser pulse, this pulse being selected of a predetermined wavelength, intensity and duration adequate to essentially completely desorb off of the inorganic oxidic surface as molecules that portion of the deposit struck by the first laser pulse and give rise to a cloud of gaseous molecules of the organic material but also such as not to bring about ionization of said molecules, d. means for passing through the cloud of gaseous molecules a second laser pulse, said second laser pulse being at a controlled time interval after said first laser pulse and being noncoaxial with said first laser pulse, being directed adjacent to but not in contact with the deposit on the inorganic oxidic surface, and being selected of a predetermined wavelength, intensity and duration adequate to effect resonance enhanced multiphoton ionization of a portion said gaseous molecules which it strikes, so as to produce a burst of gaseous ions of said molecules, e. means for detecting the ions so generated, and f. means for relating the ions so detected to the amount of nonvolatile organic material present in the sample.

33. The system of claim 32 wherein the inorganic oxidic surface is formed of glass.

34. An ion source for providing ions of molecules of a nonvolatile organic material in a mass spectrometer comprising a. a nonporous, inorganic oxide, solid support surface upon which the organic material can be physisorbed as a solid deposit, b. means for positioning the solid deposit of organic material within the ion acceleration zone of a mass spectrometer in or adjacent to one accelerator pole of said zone, c. means for striking a controlled area of the deposit with a first laser pulse adequate to desorb off of the support surface as gaseous molecules that portion of the deposit struck by said first laser pulse, with said first laser pulse and the nature of the support surface being selected and related to provide a rate of heating of the support surface struck by the laser pulse of at least $10^{6°}$ K/sec without volatilization, decomposition or ionization of the support, and d. means for passing through the cloud of gaseous molecules a second laser pulse, said second laser pulse being at a controlled time interval after the pulse of the first laser and being noncoaxial with the first pulse, being directed adjacent to but not in contact with the deposit on the inorganic oxidic surface, and being selected of a predetermined wavelength, intensity and duration adequate to effect resonance-enhanced multiphoton ionization of a portion of said gaseous molecules which it strikes, so as to produce a burst of gaseous ions within the ion acceleration zone.

35. A two-laser ion generator for generating a quantitatable burst of gaseous ions off of a deposit of nonvolatile organic solid material comprising a. a nonporous, inorganic oxidic, solid surface upon which a known thickness of the organic solid material is deposited, b. a first laser directed upon a portion of the deposit of organic solid material, said first laser being characterized as being capable of generating a pulse of a wavelength, intensity and duration adequate to essentially completely desorb off of the inorganic oxidic surface that portion of the deposit struck by the pulse and give rise to a burst of gaseous molecules, but also such as to not bring about fragmentation or ionization of said molecules, c. a second laser having its beam directed through the cloud of gaseous molecules adjacent to but not in contact with the deposit of organic solid material and the inorganic oxidic surface, said second laser being characterized as being capable of generating a pulse of a wavelength, intensity and duration adequate to effect resonance enhanced multiphoton ionization of a controlled portion of the gaseous molecules which it strikes, thereby producing the burst of gaseous ions, and d. means for relating and controlling the time of delivery of the first and second pulses such that the second pulse passes through the cloud of gaseous molecules produced by the first pulse and produces a quantitatable burst of ions of the gaseous molecules.

36. The two-laser ion generator of claim 35 additionally comprising means for serially exposing each of a plurality of portions of the deposit to a pulse of the first laser so that a plurality of portions of the deposit can be desorbed.

37. The two-laser ion generator of claim 35 additionally comprising means for moving the inorganic oxidic surface so that a plurality of portions of the deposit of organic solid material thereupon can be desorbed by a plurality of pulses of the first laser.

38. The two-laser ion generator of claim 35 wherein the inorganic oxidic surface is the inner curved surface of an inorganic oxidic cup.

39. The two-laser on generator of claim 38 wherein the inorganic oxidic cup is a glass cup.

40. The two-laser ion generator of claim 35 additionally comprising electrodes defining an ion acceleration zone wherein the inorganic oxidic surface is located adjacent to the zone.

41. The two-laser ion generator of claim 35 additionally comprising electrodes defining an ion acceleration zone wherein the inorganic oxidic surface is located in the zone.

42. The two-laser ion generator of claim 35 additionally comprising electrodes defining an ion acceleration zone wherein the inorganic oxidic surface is located in a cavity defined within one of the electrodes.

43. The two-laser ion generator of claim 42 additionally comprising means for moving the inorganic oxidic surface so that a plurality of portions of the deposit of organic solid material thereupon can be desorbed by a plurality of pulses of the first laser.

44. The two-laser ion generator of claim 43 wherein the inorganic oxidic surface is the inner curved surface of an inorganic oxidic cup.

45. The two-laser ion generator of claim 44 wherein the inorganic oxidic cup is a glass cup.

46. A two-laser ion generator for generating a burst of gaseous ions off of a deposit of heat-labile organic solid material comprising a. a nonporous inorganic oxidic, solid surface upon which the organic solid material is deposited, b. a first laser directed upon a portion of the deposit of organic solid material, said first laser being characterized as being capable of generating a pulse of a wavelength, intensity and duration adequate to desorb off of the inorganic oxidic surface that portion of the deposit struck by the pulse and give rise to a burst of gaseous molecules, but also such as to not bring about ionization of said molecules, c. a second laser having its beam directed through the cloud of gaseous molecules adjacent to but not in contact with the deposit of organic solid material and the inorganic oxidic surface, said second laser being characterized as being capable of generating a pulse of a wavelength, intensity and duration adequate to effect resonance-enhanced multiphoton ionization of a portion of the gaseous molecules which it strikes, thereby producing the burst of gaseous ions, and d. means for relating and controlling the time of delivery of the first and second pulses such that the second pulse passes through the cloud of gaseous molecules produced by the first pulse.

47. In a peptide sequencer including means for serially cleaving individual amino acid units from the peptide chain and means for identifying the cleaved amino acid units, the improvement comprising employing as the means for identifying the cleaved amino acid units a mass spectrometer, said mass spectrometer having an ion source comprising a. a nonporous, inorganic oxide, solid surface upon which at least one of the cleaved amino acid units is physisorbed as a deposit, b. a first laser directed upon a portion of the deposit of the at least one cleaved amino acid unit, said first laser being characterized as being capable of generating a pulse of a wavelength, intensity and duration adequate to desorb off of the surface that portion of the deposit of the at least one cleaved amino acid unit struck by the pulse and give rise to a burst of gaseous amino acid unit molecules, but also such as to not bring about ionization of said molecules, c. a second laser having its beam directed through the cloud of gaseous amino acid unit molecules adjacent to but not in contact with the deposit of the at least one cleaved amino acid unit and the surface said second laser being characterized as being capable of generating a pulse of a wavelength, intensity and duration adequate to effect resonance-enhanced multiphoton ionization of a portion of the gaseous amino acid unit molecules which it strikes, thereby producing the burst of gaseous amino acid unit ions, and d. means for relating and controlling the time of delivery of the first and second pulses such that the second pulse passes through the cloud of gaseous amino acid unit molecules produced by the first pulse.

48. In an oligonucleotide sequencer including means for serially cleaving individual nucleotide units from the oligonucleotide chain and means for identifying the cleaved nucleotide units, the improvement comprising employing as the means for identifying the cleaved nucleotide units a mass spectrometer, said mass spectrometer having an ion source comprising a. a nonporous, inorganic oxide, solid surface upon which at least one of the cleaved nuclectide units is physisorbed as a deposit, b. a first laser directed upon a portion of the deposit of the at least one cleaved nucleotide unit, said first laser being characterized as being capable of generating a pulse of a wavelength, intensity and duration adequate to desorb off of the surface that portion of the deposit of the at least one cleaved nucleotide unit struck by the pulse and give rise to a burst of gaseous nucleotide unit molecules, but also such as to not bring about ionization of said molecules, c. a second laser having its beam directed through the cloud of gaseous nucleotide unit molecules adjacent to but not in contact with the deposit of the at least one cleaved nucleotide unit and the surface, said second laser being characterized as being capable of generating a pulse of a wavelength, intensity and duration adequate to effect resonance-enhanced multiphoton ionization of a portion of the gaseous nucleotide unit molecules which it strikes, thereby producing the burst of gaseous nucleotide unit ions, and d. means for relating and controlling the time of delivery of the first and second pulses such that the second pulse passes through the cloud of gaseous nucleotide unit molecules produced by the first pulse.

* * * * *

UNITED STATES PATENT AND TRADEMARK OFFICE

CERTIFICATE OF CORRECTION

PATENT NO. : 4,988,879

DATED : January 29, 1991

INVENTOR(S) : Richard N. Zare, Friedrich Engelke, Jong H. Hahn

It is certified that error appears in the above-identified patent and that said Letters Patent is hereby corrected as shown below:

| | |
|---|---|
| Column 19, line 67, in Claim 10: | replace "." after ions with --,-- |
| Column 21, line 26, in Claim 21: | replace "." after zone with --,-- |
| Column 21, line 58, in Claim 23: | insert --off-- after deposit |
| Column 24, line 36, in Claim 32: | insert --of-- after portion |
| Column 26, line 58, in Claim 47: | insert --,-- after surface |

Signed and Sealed this

Thirtieth Day of June, 1992

*Attest:*

DOUGLAS B. COMER

*Attesting Officer*

*Acting Commissioner of Patents and Trademarks*